US009423178B2

(12) United States Patent
Mardikian

(10) Patent No.: US 9,423,178 B2
(45) Date of Patent: Aug. 23, 2016

(54) DEVICE FOR CONVERSION OF WASTE TO SOURCES OF ENERGY OR FERTILIZER AND A METHOD THEREOF

(76) Inventor: Albert Avedis Mardikian, Corona Del Mar, CA (US)

( * ) Notice: Subject to any disclaimer, the term of this patent is extended or adjusted under 35 U.S.C. 154(b) by 1205 days.

(21) Appl. No.: 13/371,550

(22) Filed: Feb. 13, 2012

(65) Prior Publication Data

US 2013/0205613 A1 Aug. 15, 2013

(51) Int. Cl.

| | |
|---|---|
| ***F26B 5/14*** | (2006.01) |
| ***F26B 7/00*** | (2006.01) |
| ***F23K 3/14*** | (2006.01) |
| ***F26B 19/00*** | (2006.01) |
| *F26B 1/00* | (2006.01) |
| *F26B 3/347* | (2006.01) |
| *F26B 17/04* | (2006.01) |

(52) U.S. Cl.

CPC ..... *F26B 7/00* (2013.01); *F26B 19/005* (2013.01); *F26B 1/005* (2013.01); *F26B 3/347* (2013.01); *F26B 5/14* (2013.01); *F26B 17/04* (2013.01); *F26B 2200/04* (2013.01)

(58) Field of Classification Search

CPC ..... F26B 7/00; F26B 19/00; F26B 5/14; B02C 18/182

USPC ..... 34/381–389, 391, 393–395, 398, 400, 34/60–62; 241/294, 295; 110/218, 219, 110/221, 223, 224, 232

See application file for complete search history.

(56) References Cited

U.S. PATENT DOCUMENTS

| | | | | | |
|---|---|---|---|---|---|
| 1,813,750 | A | * | 7/1931 | MacKenzie | 34/203 |
| 3,407,510 | A | * | 10/1968 | Lewis et al. | 34/443 |
| 3,473,494 | A | | 10/1969 | Siracusa | |
| 3,817,259 | A | * | 6/1974 | Strasser et al. | 131/292 |
| 3,845,220 | A | * | 10/1974 | Suzuki | 426/45 |
| 3,945,757 | A | | 3/1976 | Cummens | |
| 4,026,426 | A | * | 5/1977 | Shivvers | 198/661 |
| 4,026,678 | A | | 5/1977 | Livingston | |
| 4,063,903 | A | * | 12/1977 | Beningson et al. | 44/629 |
| 4,479,048 | A | * | 10/1984 | Kinoshita | 219/388 |
| 4,559,720 | A | * | 12/1985 | Marquardt | 34/137 |
| 4,844,353 | A | * | 7/1989 | Houle | 241/294 |

(Continued)

OTHER PUBLICATIONS

Jordan Reduction Solutions, Durable Twin Shaft Shredders, http://jordanreductionsolutions.com.*

(Continued)

*Primary Examiner* — Kenneth Rinehart
*Assistant Examiner* — John McCormack
(74) *Attorney, Agent, or Firm* — Patent Law Agency, LLC; Peter Ganjian

(57) ABSTRACT

The present invention provides a compact device (that may be installed onto a mobile or stationary platform) for conversion of waste to sources of energy or fertilizer. The device includes multiple stages for efficient conversation and processing of waste into energy or fertilizer, including a first stage for reducing a size of received waste, a second stage for compressing the reduced sized waste into partially dehydrated waste, a third stage for grinding and further compression of received waste from second stage to pulverize the constituent parts into highly dense substantially dehydrated pellets or fertilizers, with a fourth stage for further drying of the received pellets or fertilizers and a final fifth stage for cooling the received pellets or fertilizers into highly dense pellets. The device of the present invention further includes a controller for controlling each operational stage.

35 Claims, 20 Drawing Sheets

(56) References Cited

U.S. PATENT DOCUMENTS

| | | | | |
|---|---|---|---|---|
| 5,001,975 | A * | 3/1991 | Finden | 100/38 |
| 5,105,555 | A * | 4/1992 | Nakagomi | 34/259 |
| 6,089,169 | A | 7/2000 | Comiskey | |
| 6,692,544 | B1 | 2/2004 | Grillenzoni | |
| 7,252,691 | B2 | 8/2007 | Philipson | |
| 8,043,505 | B2 | 10/2011 | Noguchi et al. | |
| 2005/0274035 | A1* | 12/2005 | Beal et al. | 34/63 |
| 2007/0221362 | A1* | 9/2007 | Stewart et al. | 165/57 |
| 2008/0233310 | A1* | 9/2008 | Fujita | 428/1.6 |
| 2009/0090282 | A1 | 4/2009 | Gold et al. | |
| 2010/0179315 | A1 | 7/2010 | Medoff | |
| 2010/0281767 | A1 | 11/2010 | Zeeck | |
| 2010/0293846 | A1* | 11/2010 | Shaffer | 44/589 |
| 2010/0300368 | A1 | 12/2010 | Myers et al. | |
| 2010/0304439 | A1 | 12/2010 | Medoff | |
| 2010/0304440 | A1 | 12/2010 | Medoff | |
| 2011/0041390 | A1 | 2/2011 | Flick et al. | |
| 2011/0248109 | A1* | 10/2011 | Lesar et al. | 241/79 |
| 2012/0245257 | A1 | 9/2012 | Fascio | |

OTHER PUBLICATIONS

Jordan Reduction Solutions, Durable Twin Shaft Shredders, www.jordanreductionsolutions.com, p. 1-4.* effEnergy; BTU Values Mar. 2006;.

Jordan Reduction Solutions ; Twin Shaft Shredders; http://www.jordanreductionsolutions.com.

http://www.kunsheng.com.tw/equipments.html website.

* cited by examiner

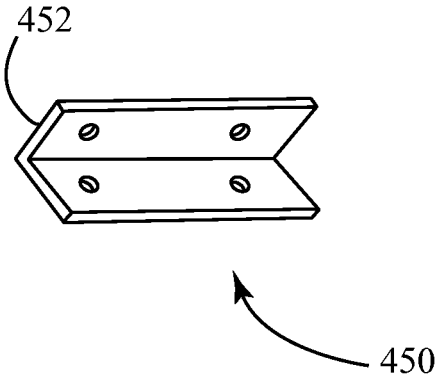
Fig. 4E
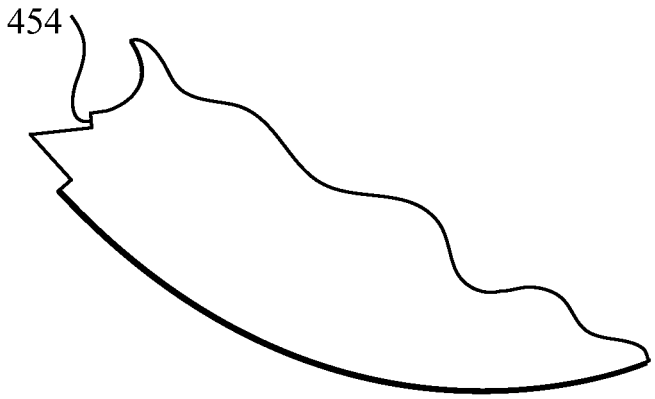
Fig. 4F
Fig. 4G
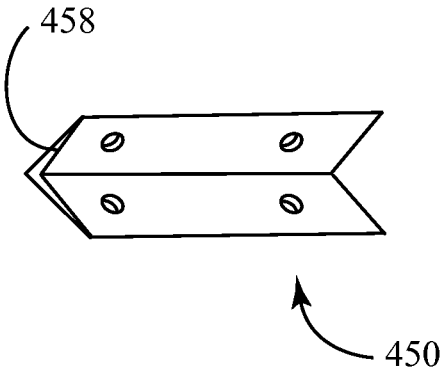

DEVICE FOR CONVERSION OF WASTE TO SOURCES OF ENERGY OR FERTILIZER AND A METHOD THEREOF

BACKGROUND OF THE INVENTION

1. Field of the Invention

This invention relates to a system for conversion of waste to sources of energy or fertilizer and, more particularly, to a compact device and process for conversion of waste to sources of energy and fertilizer.

2. Description of Related Art

Conventional processing schemes for conversion of waste products are well known and have been in use for a number of years. Regrettably, most suffer from obvious disadvantages in that they are very costly, inefficient, complex and fairly large systems that require a dedicated large facility for operation. Further, most are for recovery of salvageable components (e.g., sorting glass, metal, etc. from a salvageable component such as car) rather than recycling of waste to different sources of energy. Others are for recovery or conversion of specific types of waste such as wood products only.

Accordingly, in light of the current state of the art and the drawbacks to current waste conversion systems mentioned above, a need exists for a low cost, on-site, efficient, and compact (stationary or mobile) system for continuous (non-batch operation) conversion of waste to different sources of energy or fertilizer.

BRIEF SUMMARY OF THE INVENTION

One non-limiting, exemplary aspect of the present invention provides a compact device (that may be installed onto a mobile or stationary platform) for conversion of waste to sources of energy or fertilizer. The device includes multiple stages for efficient conversation and processing of waste into energy or fertilizer, including a first stage for reducing a size of received waste, a second stage for compressing the reduced sized waste into partially dehydrated waste, a third stage for grinding and further compression of received waste from second stage to pulverize the constituent parts into highly dense substantially dehydrated pellets or fertilizer, with a fourth stage for further drying of the received pellets or fertilizer and a final fifth stage for cooling the received pellets or fertilizers into highly dense materials. The device of the present invention further includes a controller for controlling each operational stage.

Such stated advantages of the invention are only examples and should not be construed as limiting the present invention. These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character(s) present corresponding part(s) throughout:

FIG. 4A to 4G are non-limiting, exemplary illustrations of a first module of a first stage of the device illustrated in FIGS. 1A to 3 in accordance with the present invention;

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

The present invention provides waste conversion system that may be installed on-site, is efficient, and compact (may be stationary or mobile) system for continuous (non-batch operational) conversion of waste to different sources of energy or fertilizer. The present invention is efficient in that the device consumes or requires much less power to generate fertilizer or pellets. The processing of the waste is also accomplished efficiently in that the time to convert waste to pellets or fertilizer is much shorter (about 15 minutes) due to the fact that the process of conversion is continuous. In other words, unlike the conventional systems, with the present invention, there is no need to convert a first batch of waste prior to commencing conversion on a second batch, but the entire waste conversion may be done continuously. With conventional systems, once a conversion process commences, users must have to wait for a long period of time until the process is completed, and then start a new batch. Further, with the present invention, the entire system is so compact that it may be installed on-site or on mobile platforms. The mobile systems may be placed on utility waste collection vehicle wherein as the waste is collected, the waste is continuously processed by the present invention, continuously generating pellets or shredded pulverized product (e.g., fertilizer).

Figure 1A:
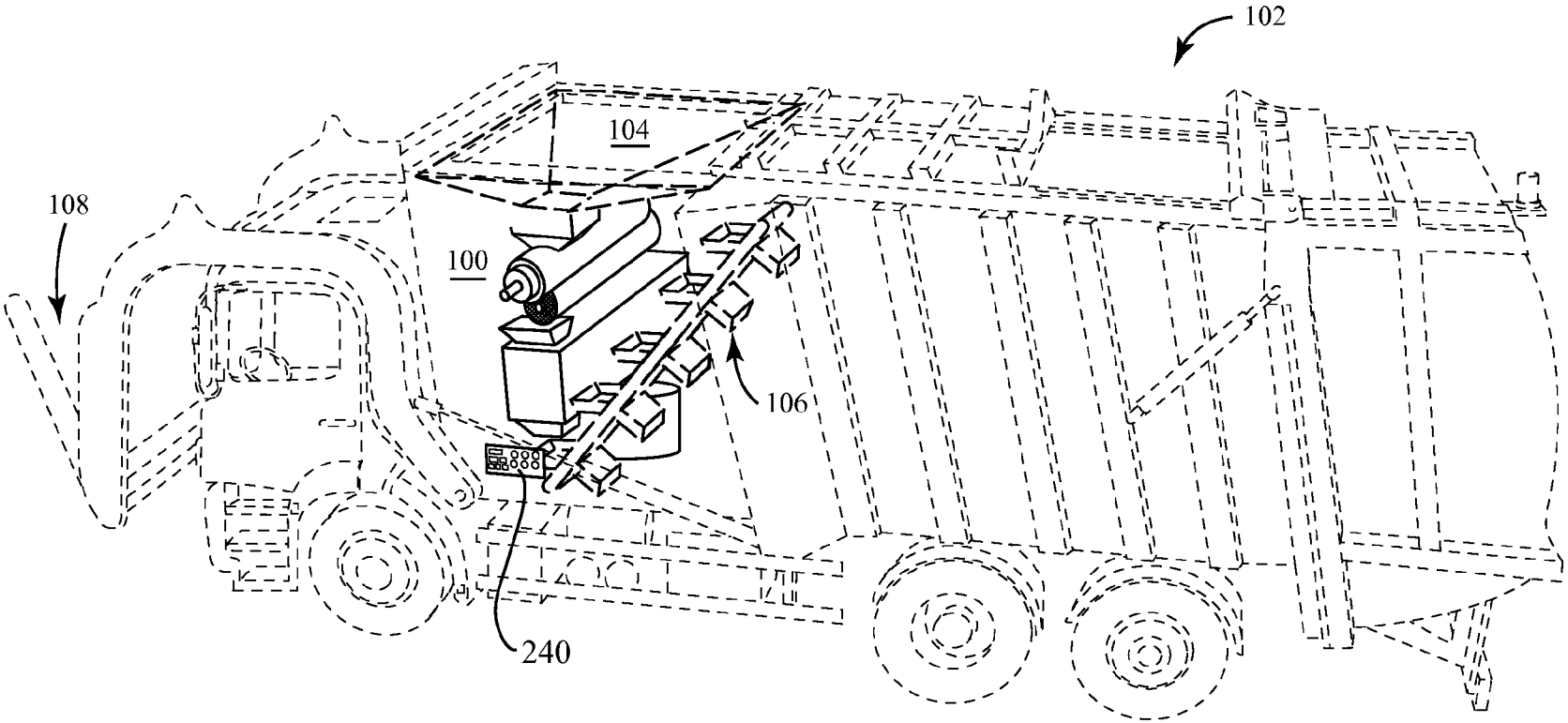
FIG. 1A is a non-limiting, exemplary illustration of a device for conversion of waste to sources of energy in accordance with the present invention installed onto a non-limiting, exemplary mobile platform.
Figure 1B:
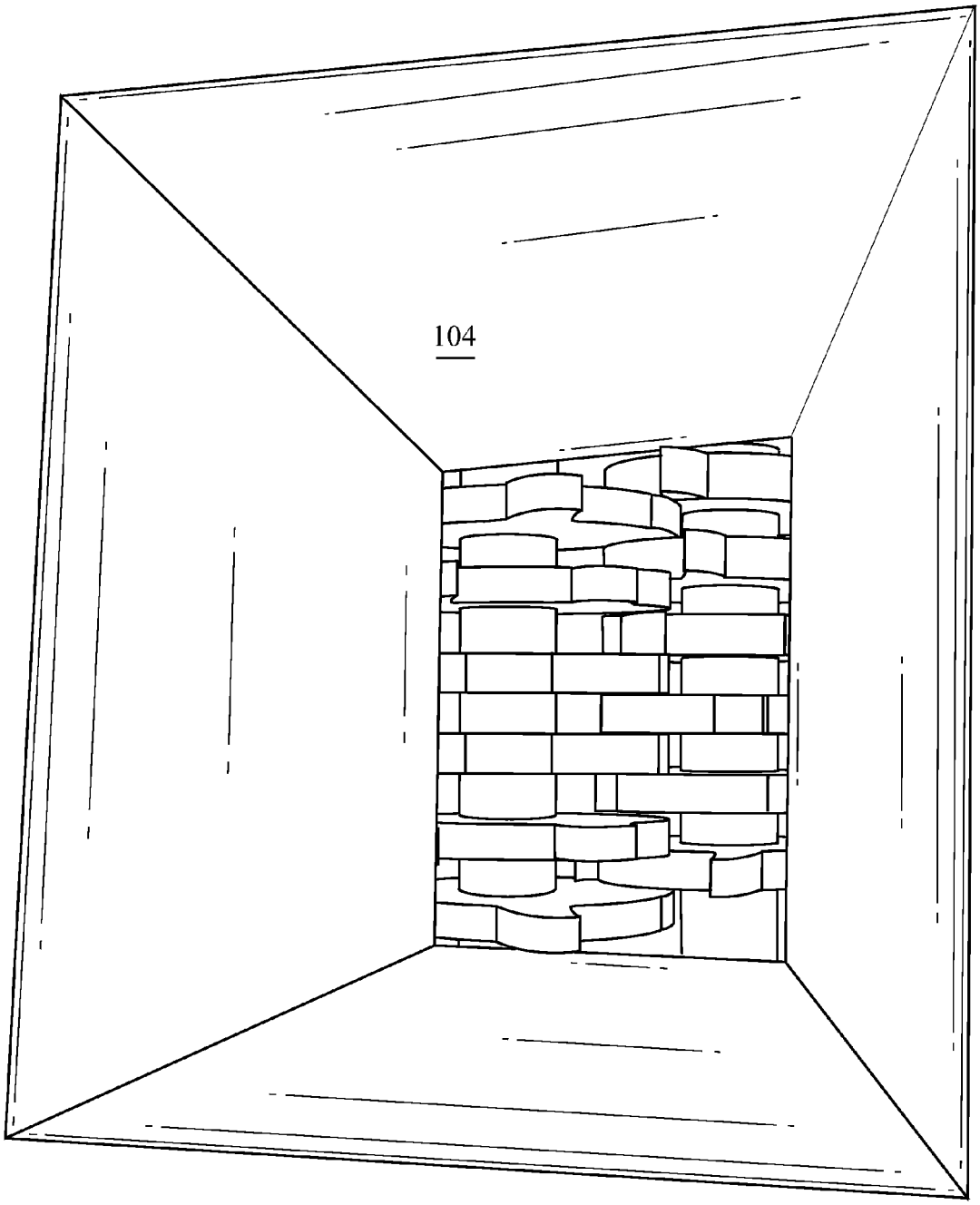
FIG. 1B is a non-limiting exemplary top view illustration of a first stage hopper, showing a portion of a shredder in accordance with the present invention.

FIG. 1A is a non-limiting, exemplary illustration of a device for conversion of waste to sources of energy or fertilizer in accordance with the present invention installed onto a non-limiting, exemplary mobile platform, and FIG. 1B is a non-limiting exemplary top view illustration of a first stage hopper, showing a portion of a shredder in accordance with the present invention. As illustrated in FIGS. 1A and 1B, the present invention provides a waste to energy (or fertilizer) conversion device 100 that may be used with a mobile platform 102 or a platform that is stationary (installed within a restaurant or other establishments) to convert waste into various forms of usable energy (or fertilizer). Non-limiting example of a mobile platform 102 may be conventional utility waste collection vehicle such as garbage ship, boat, truck, or other mobile vehicles that includes the device 100 secured thereon as illustrated. In the non-limiting example of a garbage truck, the device 100 may be installed onto a truck bed, enabling trash or other waste to be dropped through a receiving member 104 (in the form of a hopper) of device 100 for further processing. The finally processed waste is then moved from the device 100 via a conveyer system 106, and is dumped into a conventional collection bin of the vehicle.

Figure 2:
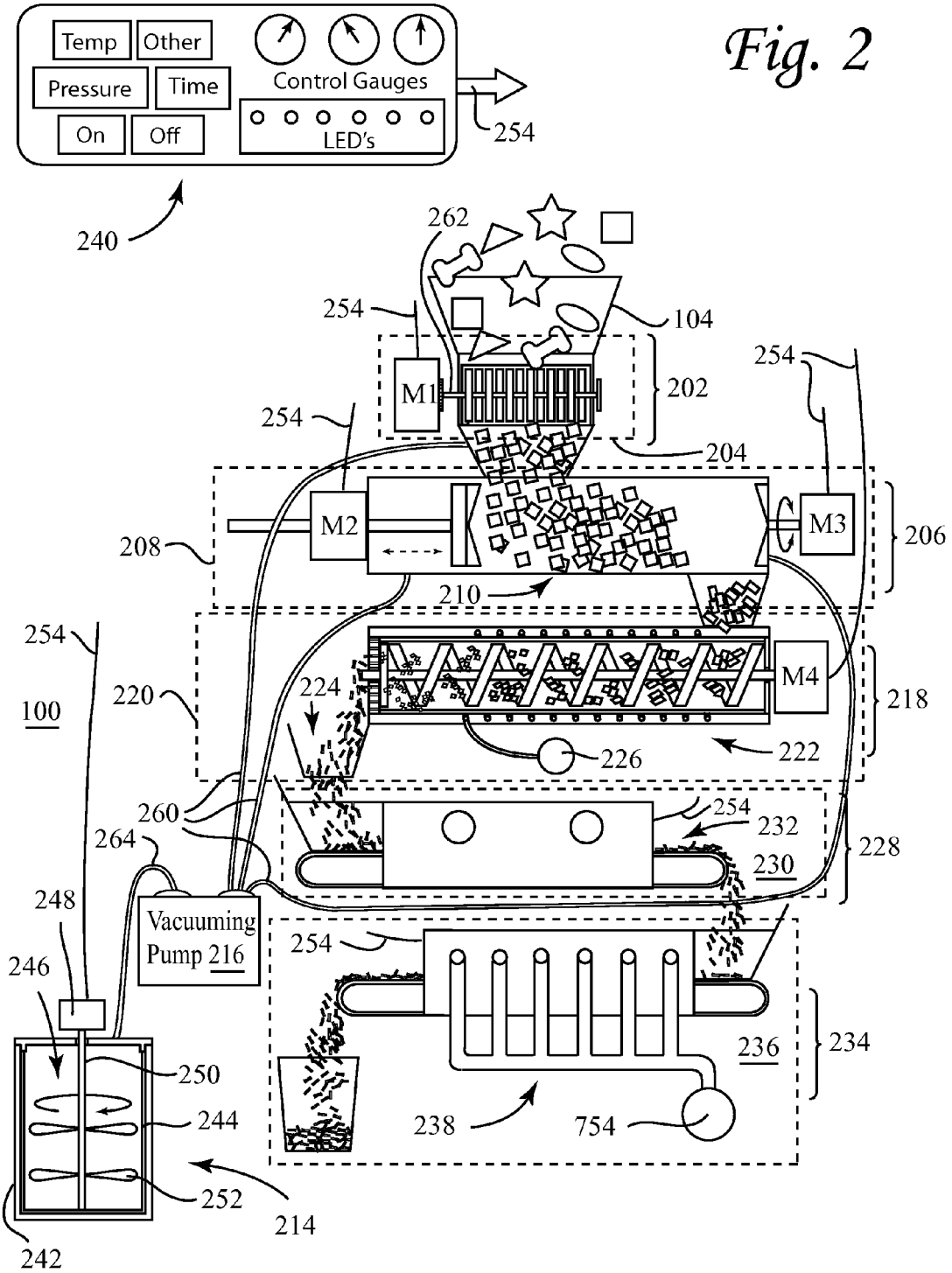
FIG. 2 is non-limiting, exemplary schematic of a general system overview of the device of FIGS. 1A and 1B in accordance with the present invention.

FIG. 2 is non-limiting, exemplary schematic of a general system overview illustration of device 100 of FIGS. 1A and 1B in accordance with the present invention. As illustrated, device 100 is comprised of a receiving member 104 in the form of a feed mechanism such as a hopper for receiving waste. The hopper 104 has an ingress cross-sectional opening for receiving the waste, and an egress cross-sectional opening that enables a part of a first mechanism of a first stage (detailed below) to extend out from the egress cross-sectional opening of the hopper 104 (shown in FIG. 1B). The ingress cross-sectional opening of the hopper 104 is wider than the egress cross-sectional opening thereof. The waste is simply dumped into the device 100 via the non-limiting exemplary hopper 104 for further processing. The dumping of waste may be accomplished by a variety of means, non-limiting examples of which may include by individuals (for stationary devices located within restaurants for example) or alternatively, by a conventional mechanical arm 108 of the utility waste collection vehicle 102 that is adapted to lift trash bins.

As further illustrated in FIG. 2, the device 100 of the present invention is comprised of multiple stages that process incoming waste, including a first stage 202 that has a first module 204 for reducing a size of the received waste via the hopper 104 into smaller constituent parts. Further included is a second stage 206 that includes a second module 208 that comprises a second mechanism 210 for application of a compressive force for pressing and extraction of liquid from smaller constituent parts, generating partially dehydrated smaller constituent parts (that are about 40% dry), with the extracted liquid drawn out by a vacuum pump 216 via vacuum pump tubes 260, filtered for removal of solids, and stored as a first source of energy (which may be used to create methane) within a storage module 214.

As further illustrated in the systems overview in FIG. 2, the device 100 of the present invention is further comprised of a third stage 218 that includes a third module 220 that receives the partially dehydrated, compressed smaller constituent parts, and includes a third mechanism 222 for further compression, grinding, and application of heat (e.g., in the form of high speed heated air via a heat pump 226) to pulverize the constituent parts into highly dense substantially dehydrated pellets 224. It should be noted that at this stage, heat is also generated due to the immense pressure from the compression of the dry waste particles. That is, the compression force of the dry waste particles also generates heat. In general, the temperature at this third stage 218 is above 150° F., which is sufficient to kill most bacteria. The third stage 218 is a slower process in that it requires sufficient time to allow the substantially dehydrated waste particles to dry. The highly dense substantially dehydrated pellets 224 exiting this stage are about 60% or more dry.

As further illustrated in FIG. 2, the device 100 also includes a fourth stage 228 that includes a fourth module 230 that receives the highly dense substantially dehydrated pellets, and includes a fourth mechanism 232 that further dry the pellets 224. In general, the temperature within the fourth stage 228 is above 150° F., and it will take about 7 minutes for a single pellet 224 to move from a first distal end of the fourth stage 228 to the second distal end (exiting side) thereof. Temperature and speed of transportation may be varied and should not be limiting.

As illustrated in FIG. 2, the device 100 further includes a fifth stage 234 that includes a fifth module 236 that receives the substantially dried, heated pellets, and includes a fifth mechanism 238 for cooling the heated pellets 224, which increase the pellet density. In general, it will take about 3 minutes for a single pellet to move from a first distal end to the second distal end (exiting side) of the fifth stage 234, with the both the speed and temperature varied commensurate with various requirements. As further illustrated in FIG. 2, the device 100 also includes a controller 240 that is coupled with various stages via control lines 254 for controlling each operational stage. The device 100 includes the storage module 214 that has a container 242 within which is included a heating element 244 to substantially eliminate order and bacteria, and an agitator 246 that continuously mixes the liquid for even distribution of heat. As illustrated, the agitator 246 is comprised of a motor 248, a shaft 250 coupled with the motor 248, and a set of rotator blades (paddles or propellers) 252 coupled with the shaft 250 that rotate to mix the stored liquid.

Figure 3:
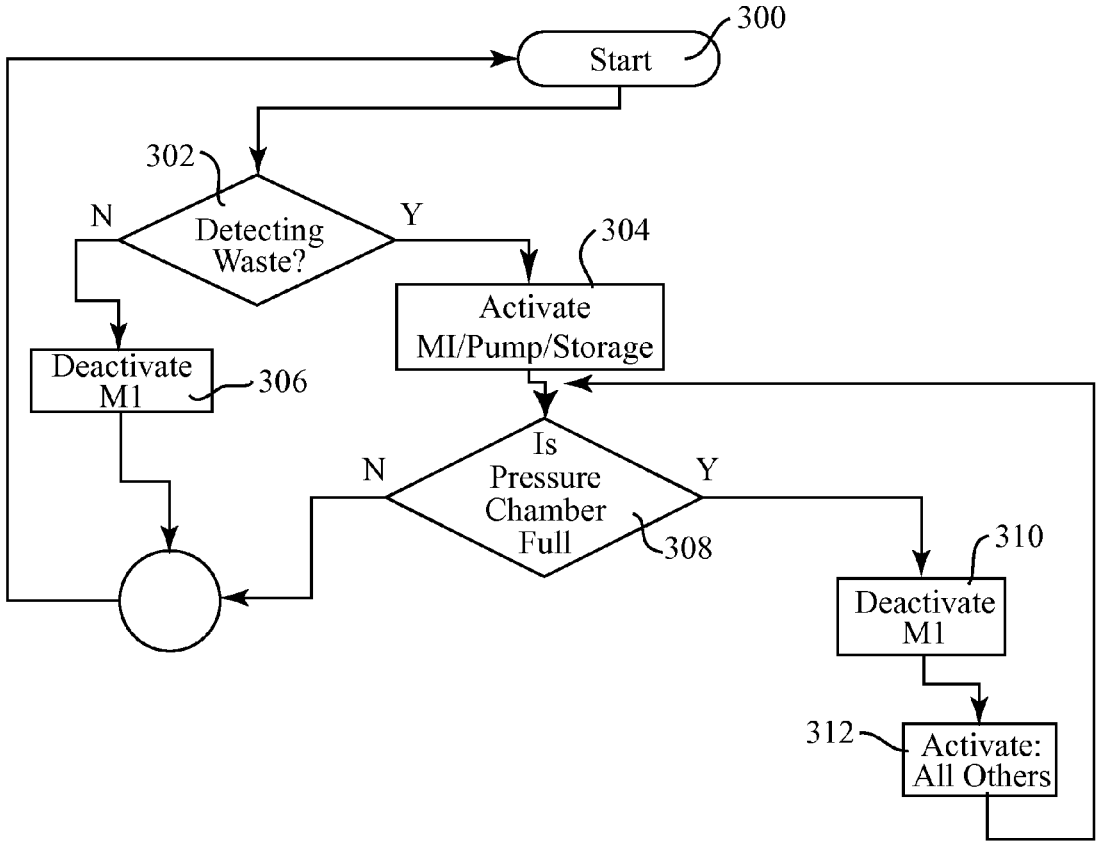
FIG. 3 is a non-limiting, exemplary flowchart that provides a general overview of the overall systems level operation of the device of FIGS. 1A to 2 in accordance with the present invention.
Figure 4A:
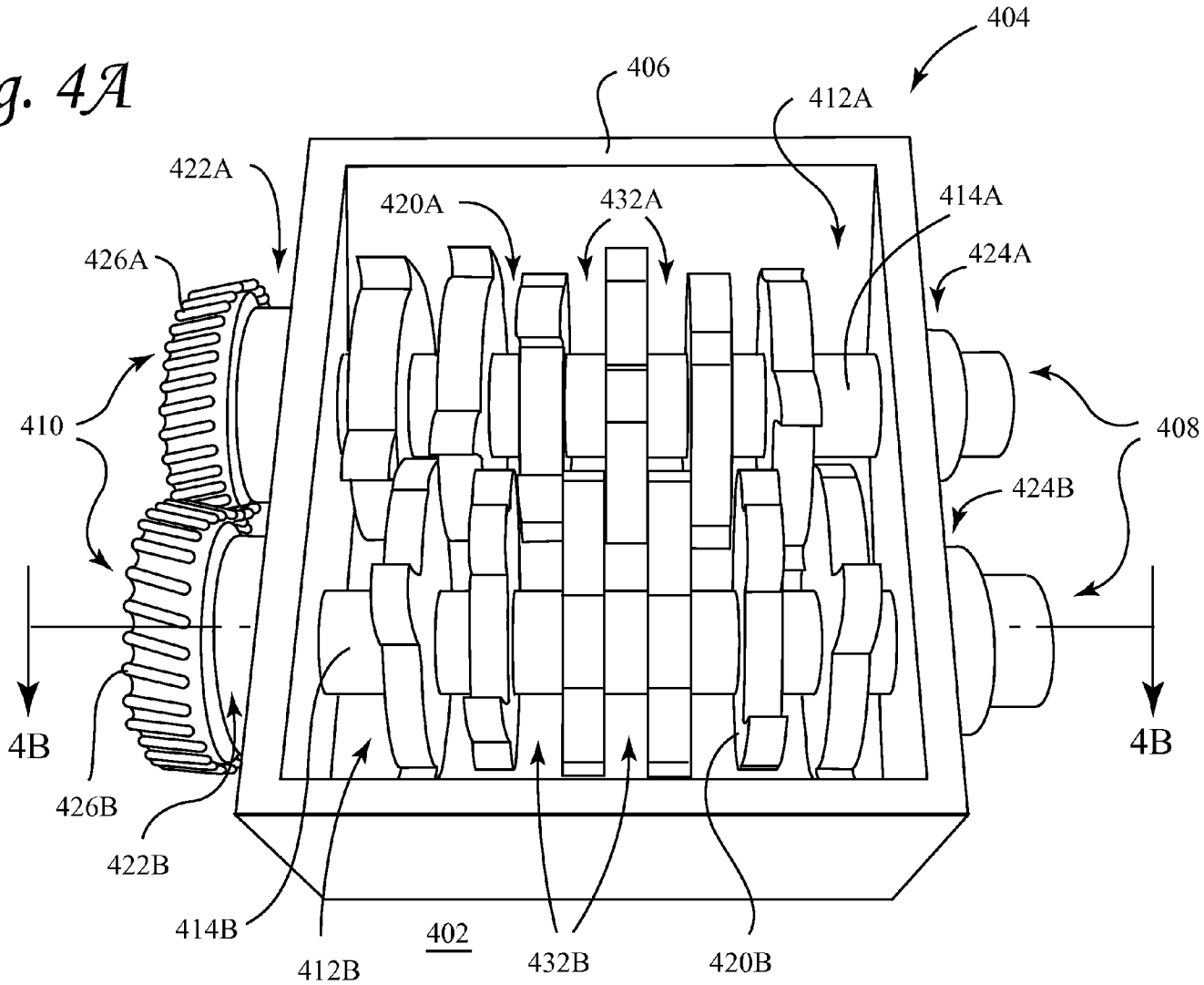
Figure 4B:
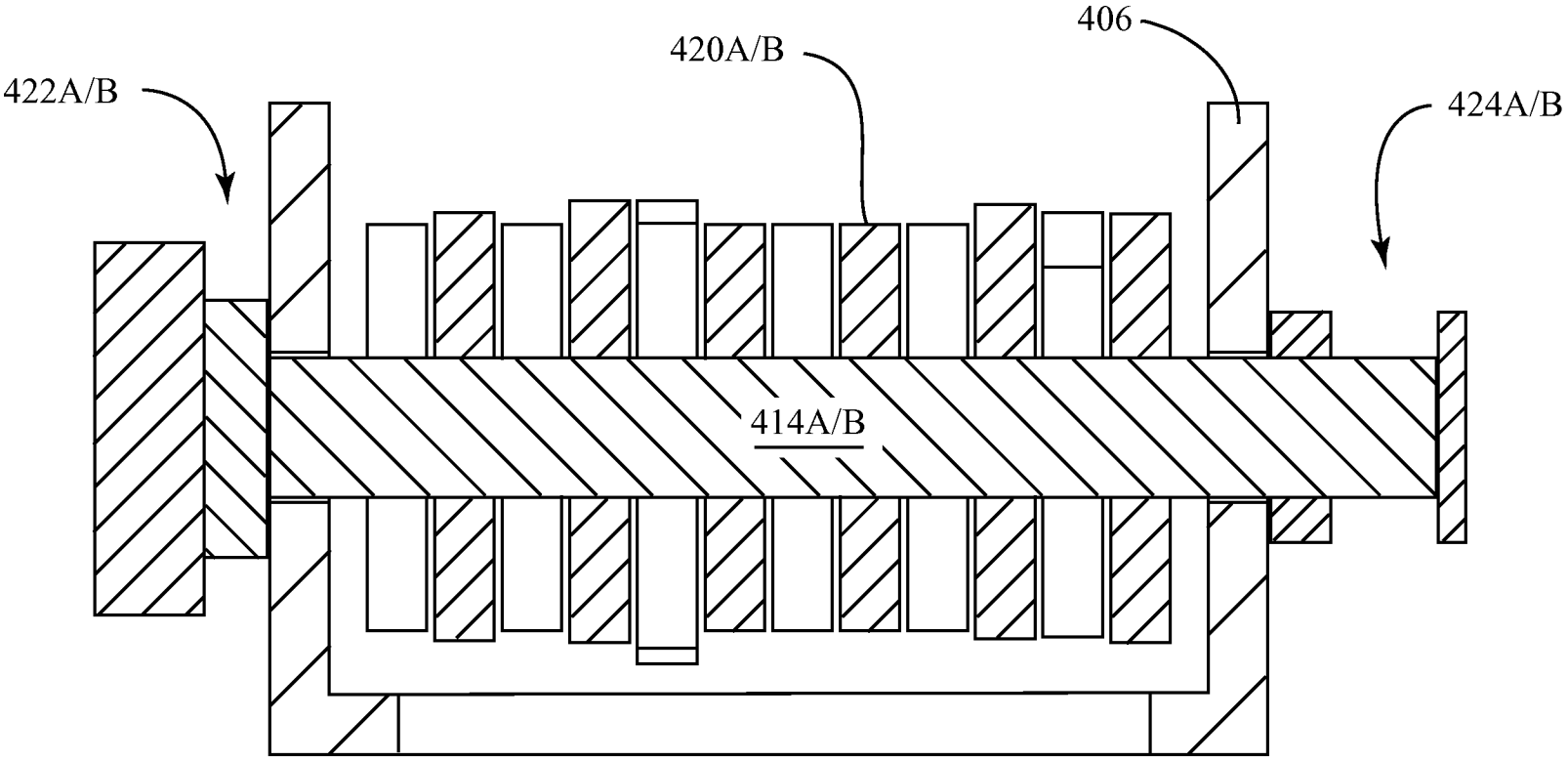
Figure 4C:
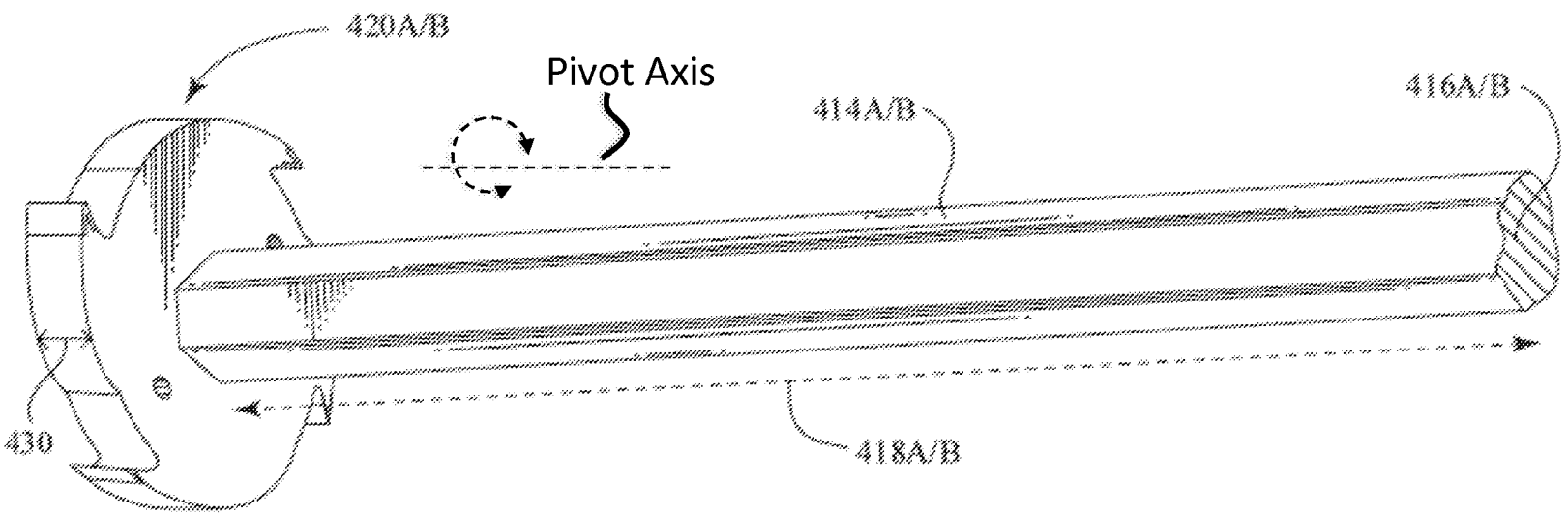
Figure 4D:
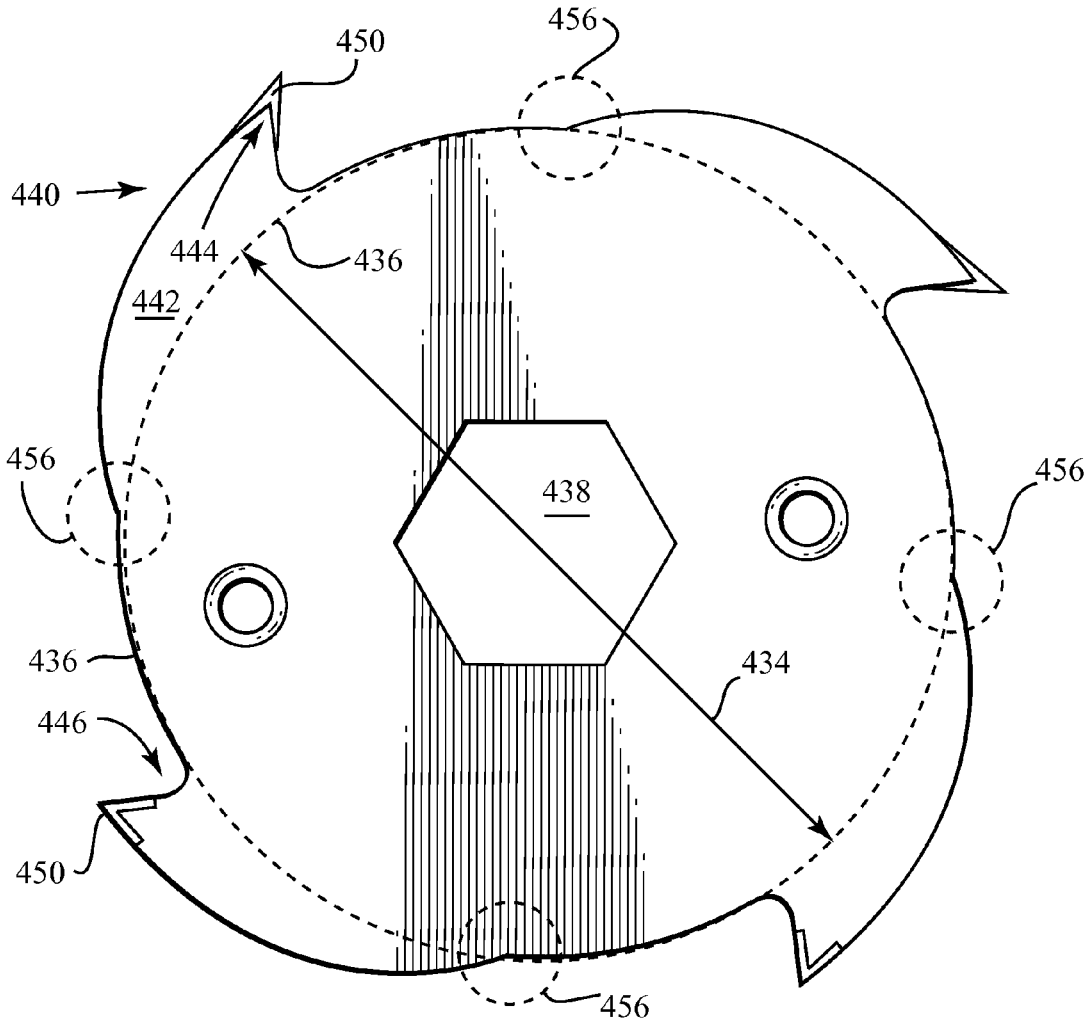

FIG. 3 is a non-limiting, exemplary flowchart that provides a general overview of the overall systems level operation of the device 100 in accordance with the present invention. The device 100 is ready for operation (indicated as the operational functional act 300), and includes various well-known sensors (e.g., pressure, temperature, motion, etc.) and switches that enable the proper and efficient operation of the various stages at appropriate times. For example, the device 100 includes well-known sensors associated with the receiving member (e.g., the hopper 104) that may detect the presents of waste, and report a detected waste signal to the controller 240. At the operational functional act 302, if the controller 240 determines that waste is present in the hopper 104 (shown in FIGS. 1A to 2), the controller 240 transmits an activation signal to the first stage 202, activating the first module 204 at the operational functional act 304 for reducing the size of the received waste (via the hopper 104) into smaller constituent parts. The controller 240 also activates the pump 216 and storage module 214 upon activation of the first module 204 to vacuum residual waste liquid and store inside the storage module 214. On the other hand, if at the operational functional act 302 the controller 240 determines (via detected signals from the hopper 104 sensors) that waste is not present in the hopper 104, the controller 240 may simply deactivate the first stage 202 operations at the operational functional act 306, and wait for detected waste signal from the hopper waste sensors. The pump 216, the storage module 214, and other stages may continue to be active, depending on the detected presence or absence of waste in other stages. For example, no waste may be detected in the hopper 104, but the second and the remaining subsequent stages may have waste that is being processed, which enables non-batch, continuous processing of waste by device 100.

As further illustrated in FIG. 3, at the operational functional act 308 the controller 240 determines if the second mechanism 210 of the second stage 206 is full to a predetermined capacity. If the controller 240 determines that the second mechanism 210 is full, the controller 240 deactivates the first stage 202, and activates the second mechanism 210 for application of a compressive force for pressing and extraction of liquid from smaller constituent parts, generating partially dehydrated smaller constituent parts, with the extracted liquid drawn out by the active vacuum pump 214 via vacuum pump tubes 260, and stored in the storage module 214. On the other hand, if the controller 240 determines that the second mechanism 210 is not full to capacity, second mechanism 210 will remain deactivated, while the first stage mechanism 204 may or may not be active, depending on the sensed waste inside the hopper 104. If the controller 240 determines at the operational functional act 308 that the second mechanism 210 is full to the predetermined capacity, the controller 240 deactivates the first mechanism 204 at operational functional act 310 and activates the remaining stages at operational functional act 312 for (and at) an appropriate time in accordance with a predetermined scheme for an efficient operation of the various stages. It should be noted that additional logic and timing schemes may be used for a more efficient operation of the device 100. For example, each stage may have its own set of timers/sensors for a finer, more granulated coordination (or "hand-shake") between stages. As an example, during the operation of the device 100, the first and second stages 202 and 206 may be empty (have no waste to be processed) while other stages may have remaining waste that is being processed. For example, the utility waste collection vehicle 102 may be on the move from a recent collection of trash, where first and second stages 202 and 206 have already processed the waste, but the remaining stages are functioning to process the remaining waste into energy or fertilizer. Accordingly, additional set of timers/sensors may be included for a finer, more granulated coordination (or "hand-shake") between stages for a more efficient operation of device 100.

FIG. 4A to 4G are non-limiting, exemplary illustrations of a first module of a first stage of the device illustrated in FIGS. 1A to 3 in accordance with the present invention. As illustrated in FIGS. 1A to 4G, after waste enters the receiving member 104, it is processed by the first stage 202 that includes a first module 204 for reducing a size of the received waste into smaller constituent parts. The first module 204 of the first stage 202 includes a shredder mechanism 402 that masticates, chops, shreds, and grinds waste into smaller constituent parts. The shredder mechanism 402 is comprised of a shredder assembly 404, a first motor M1, and a drain (best illustrated in FIG. 2) for removal of liquid from shredder assembly 404, with the drain coupled to a vacuum pump line 260. The extracted liquid is drawn out via vacuum pump 216, filtered for removal of solids, and stored as a first source of energy in the storage module 214 via a pump exit line 264, which may later be used to create methane.

The shredder assembly 404 includes a shredder housing 406 that accommodates a dual or twin shaft shredder 408 with a dual shaft transmission/gear system 410. The dual shaft shredder 408 is comprised of first and second shredder shaft assembly 412A and 412B that are associated with the shredder housing 406. The first shredder shaft assembly 412A includes a first shredder shaft 414A that has a first polygonal cross-section 416A with a first axial length 418A that further includes a first drive-shaft end 422A and a first bearing-shaft end 424A. The first shredder shaft assembly 412A also includes a first set of shredder plates 420A that are substantially equally spaced, juxtaposed adjacent one another, mounted onto, and aligned along the first axial length 418A of the first shredder shaft 414A. The first drive-shaft end 422A includes a first gear assembly 426A coupled with a second gear assembly 426B with one of the first or second gear assemblies 426A and 426B coupled with a drive shaft 262 of the first motor M1, wherein when the drive shaft 262 of the motor M1 rotates a motor gear assembly coupled therewith, both the first and second shredder shaft assembly 412A and 412B rotate, with the first gear assembly 426A rotating clockwise and the second gear assembly 426B rotating counterclockwise so that an upper section of rotation of both the first and second gear assemble 426A and 426B are towards one another.

As further illustrated in FIGS. 4A to 4G, the shredder assembly 404 further includes the second shredder shaft assembly 412B that has a second shredder shaft 414B that has a second polygonal cross-section 416B with a second axial length 418B that further includes a second drive-shaft end 422B and a second bearing-shaft end 424B. The second shredder shaft assembly 412B further includes a second set of shredder plates 420B that are substantially equally spaced, juxtaposed adjacent one another, mounted onto and aligned along the second axial length 418B of the second shredder shaft 414B. The second drive-shaft end 422B includes the second gear assembly 426B coupled with the first gear assembly 426A, with one of the first or second gear assembly 426A and 426B coupled with a drive shaft 262 of the motor M1.

The first and second shredder shafts 414A/B are positioned within the shredder housing 406 and juxtaposed adjacent one another longitudinally along their respective first and second axial lengths 418A/B with the first and second drive-shaft end 424A/B of the first and second shredder shafts 414A/B associated with a first wall of the shredder housing 406, and the first and second bearing-shaft end 422A/B of the first and second shredder shaft 414A/B associated with a second wall of the shredder housing 406, with the first and second walls of the shredder housing 406 oriented transverse a longitudinal axis 418A/B of the first and second shredder shafts 414A/B. As illustrated, the first set of shredder plates 420A encroach a second set of void spaces 432B of the second shredder shaft assembly 412B, and the second set of shredder plates 420B encroach a first set of void spaces 432A of the first shredder shaft assembly 412A.

As best illustrated in FIGS. 4D to 4G, the shredder plates 420A/B have a pivot axis that is normal to a radial plane of the shredder plates 420A/B. The shredder plates 420A/B further have a substantially disc structure with a thickness 430 (FIG. 4C) along the pivot axis, a diameter 434 that defines a span of the lateral face, which is the radial plane of the shredder plates 420A/B, a circumference that defines the radial outer periphery (or radial distal end) 436, and a radial center 438.

Further included with the shredder plates 420A/B are severing members 440 that protrude from a radial outer periphery 436 of the shredder plates 420A/B, and a mounting through-hole 438 oriented transverse the radial plane for insertion of the shredder shaft 414A/B and mounting of the shredder plate 420A/B thereon, with the mounting through-hole 438 having a perimeter and a cross-sectional span that is configured commensurate with the cross-section of the shredder shaft 414A/B. It should be noted that although in this instance the mounting through-hole and the radial centre of the shredder plate coincide and are the same, the mounting through-hole 438 may be off-centered, forming an eccentrically configured shredder plate.

As further illustrated, the severing members 440 protrude from the radial outer periphery 436 of a shredder plate 420A/B at a progressively, smooth increasing angle of about 15° to 30° degrees, forming a radial outward projecting shoulder 442 that ends at a tip 444, forming a radial recessed inner portion 446, with the radial outward projecting shoulder 442 and the radial recessed inner portion 446 constituting a cutting-wing of the severing member 440. It should be noted that radial recessed inner portion facilitates in the grip of waste. The shredder plates 420A/B further include indentations 456 (notches, dips, or dimples, etc.) along the radial outer periphery 436 that are positioned between the tips 444, and define a start position (at a 15 to 30 degrees) from which the severing members 440 commence protruding, and an end position at which the radial outer periphery 436 from an end of the radial recessed inner portion 446 ends. In general, the severing members 440 use the indentations 456 to further agitate, mix, and facilitate griping of the waste products. It should be noted that the indentations 456 must not be so deep to "trap in" the waste, but must be of sufficient depth so to mix or agitate the waste. The tip 444 of the severing members 440 facilitates mounting and installation of sharp blades 450 by a set of fasteners, with the blades covering the tip 444 along the thickness 430 of the plate 420A/B and is comprised of carbide and alloys thereof. The tip 444 of the cutting-wing 442 of a shredder plate 420A/B on a shredder shaft 418A/B is oriented in the same direction of the orientation of the tip 444 of the cutting-wing of a next adjacent shredder plate 420A/B on the same shredder shaft 418A/B. As illustrated in FIGS. 4E to 4G, the sharp blades 450 covering the tip 444 of the severing members 440 may be coupled with the tips 444 in a number of ways, two non-limiting examples of which are illustrated in FIGS. 4E and 4G. For example, as illustrated in FIG. 4E, the blades 450 may comprise of straight lateral edges 452 that are accommodated within the notches 454 of the tip 444 or, as an alternative example, the blades 450 (FIG. 4G) may comprised of beveled lateral edges 458 that become flush with the tips 444, without requirement of any notches 454 on the plates 420A/B.

Figure 5A:
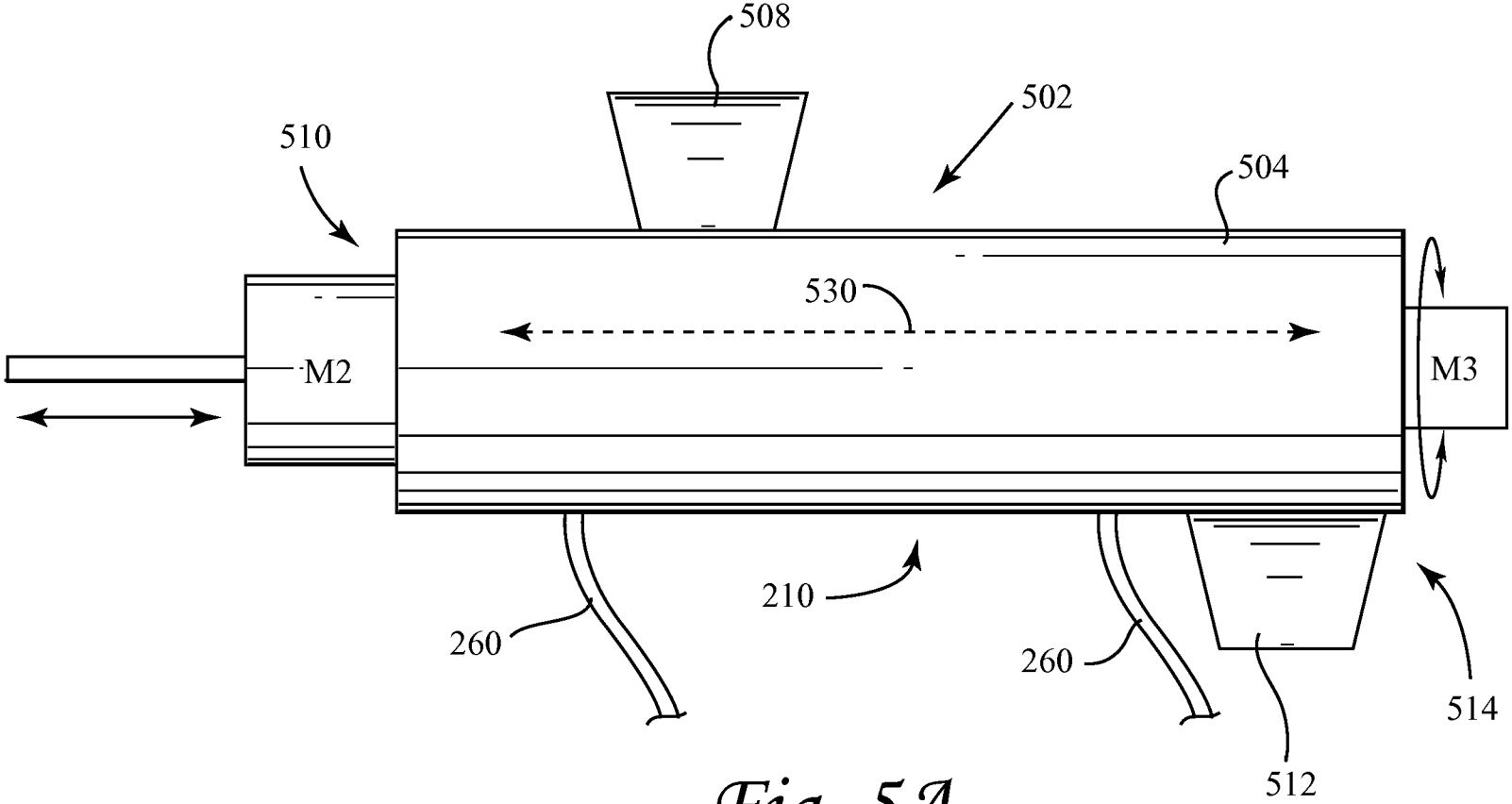
FIGS. 5A to 5C are non-limiting, exemplary illustrations of a second mechanism of a second module of a second stage of the device of FIGS. 1A to 4G in accordance with the present invention.
Figure 5B:
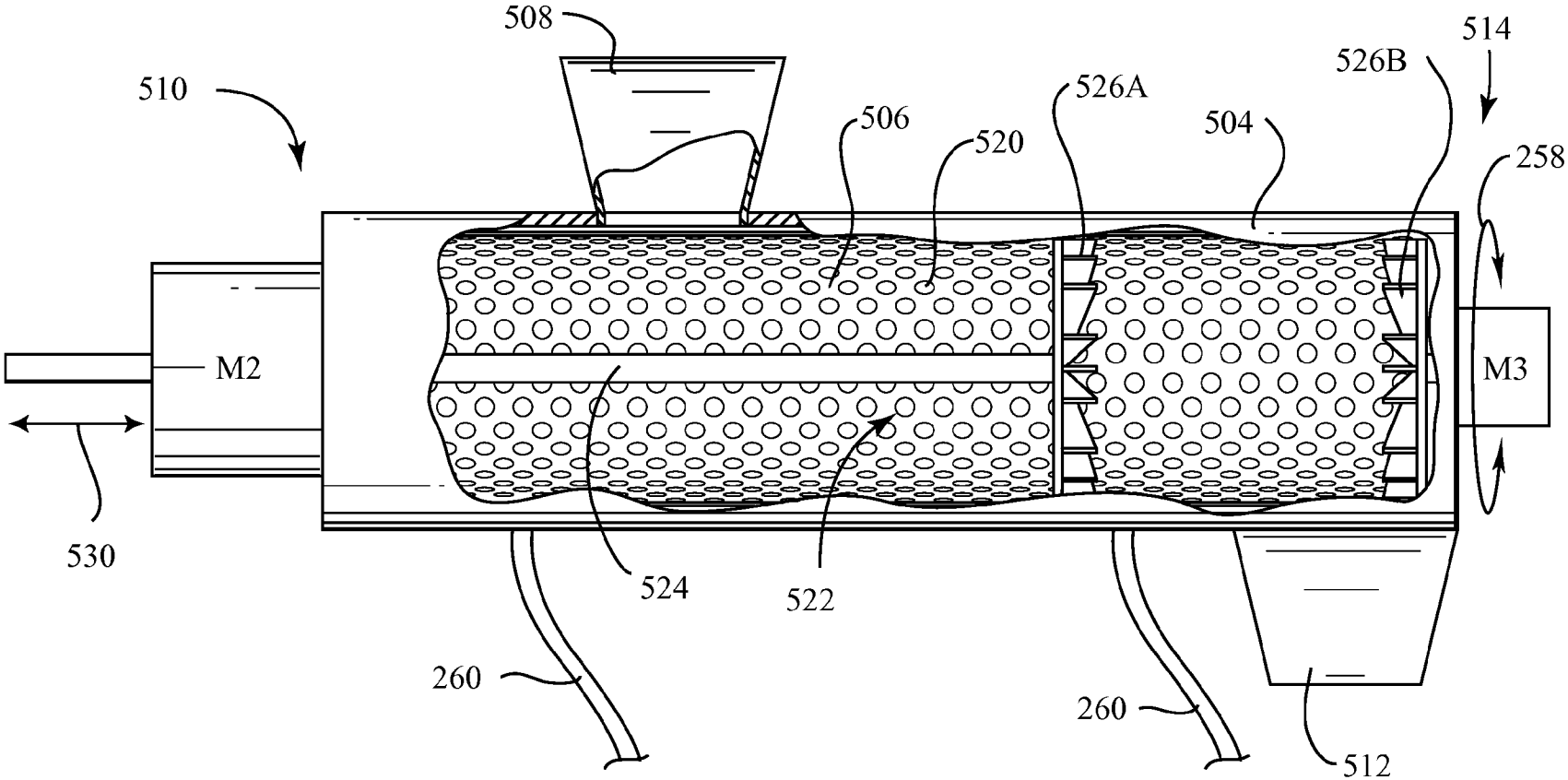
Figure 5C:
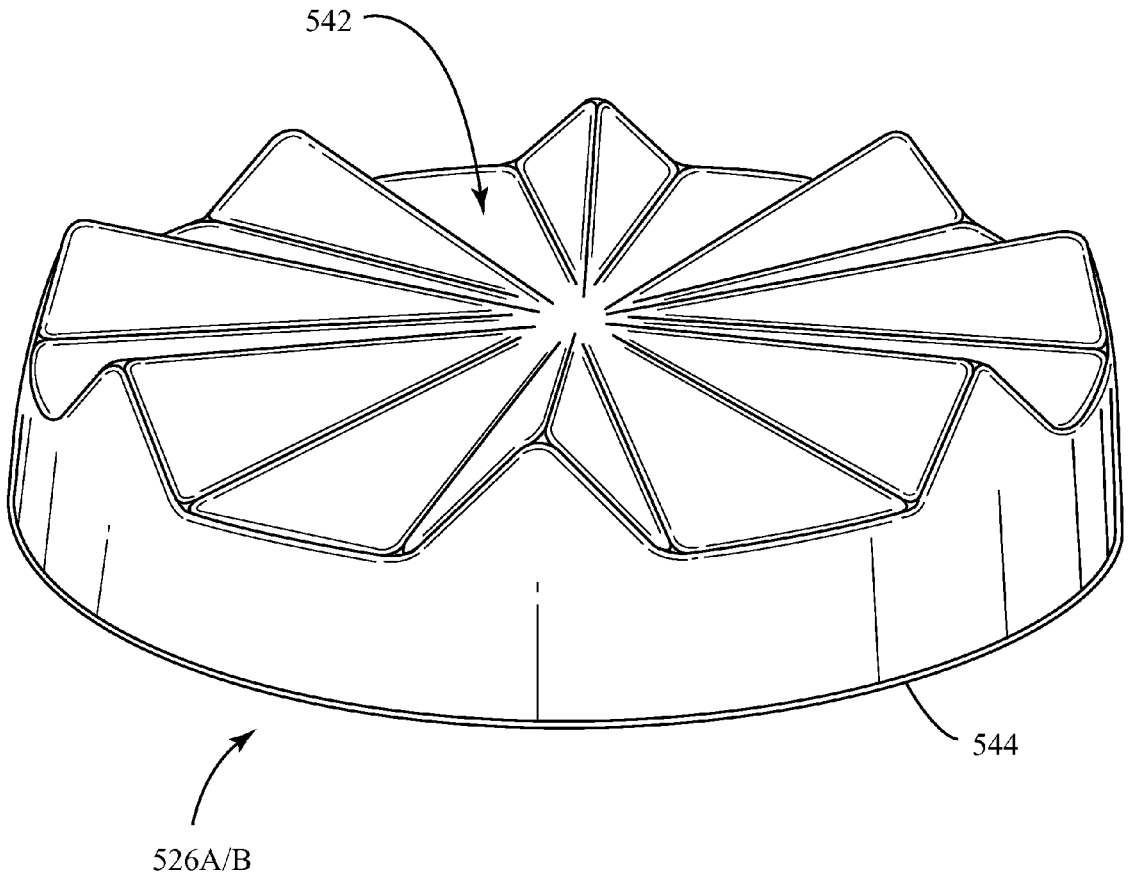

FIGS. 5A to 5C are non-limiting, exemplary illustrations of a second mechanism of a second module of a second stage of the device of FIGS. 1A to 4G in accordance with the present invention. As illustrated, the second stage 206 includes the second module 208 that comprises the second mechanism 210 for application of a compressive force for pressing and extraction of liquid from smaller constituent parts, generating partially dehydrated smaller constituent parts (that are about 40% dry), with the extracted liquid drawn out by a vacuum pump 216 via vacuum pump lines 260. The second mechanism 210 of the second module 208 includes a second chamber 502 that is a compression chamber that includes an outer module 504 and an inner module 506. The outer module 504 includes an ingress hopper 508 connected near the first end 510 and an egress hopper 512 connected opposite the ingress hopper 508 near the second end 514, and further includes coupling mechanisms for second and third motors and the vacuum lines 260. The inner module 506 is comprised of drainage apertures 520 that enable accumulated liquid within the inner module 506 to drain out into the interior of the outer module 504 and be removed by the first and second vacuum lines 260. The inner module 506 may be configured commensurate with outer module 504. The inner module 506 drainage apertures 520 have a non-limiting, exemplary size of about 3 mm and are spread across the surface of the inner module 506.

As further illustrated in FIGS. 5A to 5C, the second mechanism 210 further includes the second motor M2 at the first end 510 of the second chamber 502 and a third motor M3 at a second end 514 of the second chamber 502. The second motor M2 is coupled with a piston shaft 524 of a piston 522 to move the piston 522 along a longitudinal axis 530 of the second chamber 502 to compress the smaller constituent parts into substantially dehydrated smaller constituent parts of about 40% dry, with the pressure at about 150 to 350 psi. The third motor M3 is a bidirectional rotator motor that is coupled with a plate shaft of a plate 526B for bidirectional rotation of the plate 526B along a bidirectional reciprocating rotational path 528. Within this second stage 206, the second motor M2 pushes the smaller constituent parts from the first end 510 to the second end 514 of the second chamber 502, towards the pivoting plate 526, while the pivoting plate 526B rotates back-and-forth to further compress and squeeze out and extract further liquid from the smaller constituent parts. The compression piston 522 moves to about a distance of 6 cm away from the plate 526. It should be noted that the back-and-forth rotation of the plate 526B also pushes the remaining solid waste out of the chamber 502 and into the egress hopper 512 and to the next stage for further processing. The second vacuum line 260 positioned near the first end 510 of the second chamber 502 and a third vacuum line 260 positioned near the second end 514 of the second chamber 502 remove the extracted liquid. It should be noted that the piston 522 may be a compression piston and the compression chamber (the second chamber 502) may be a hydraulic compression chamber with the second motor M2 being a hydraulic motor. As best illustrated in FIG. 5C, the compression piston 522 with its plate 526A and the plate 526B are comprised of a disc with a first and second sides 542 and 544, with the first side 542 facing and contacting the particles, which includes a surface with protrusions and indentations to grip and squeeze particles. The second side 544 is substantially flat and faces the connection points of the piston shaft and the third motor shaft. As with other stages, this stage also includes a plethora of timers and sensors for sensing motion, pressure, temperature, etc. for correct and efficient operation.

FIGS. 6A to 6E are non-limiting, exemplary illustrations of a third mechanism of a third module of a third stage of the device of FIGS. 1A to 5C in accordance with the present invention. As illustrated in FIGS. 6A to 6E and indicated above, the third stage 218 includes a third module 220 that receives the partially dehydrated, compressed smaller constituent parts from the second stage 206, and includes a third mechanism 222 for further compression, grinding, and application of heat (e.g., in the form of high speed heated air) to pulverize the constituent parts into highly dense substantially dehydrated pellets 224. The third module includes a third chamber 602, having an outer unit 604 and an inner unit 606.

The outer unit 604 includes an ingress hopper 608 connected near a first end 610 and an egress hopper 612 connected opposite the ingress hopper 608 at near a second end 614, and further includes coupling mechanisms for a fourth motor M4 and a heat pump 226. The pelletized waste 224 is dropped out of the egress hopper 612 and into the next stage. The inner unit 606 is comprised of heat vents 618 that enable heat to be pumped within the inner unit 606 (and confined within the outer unit 604) to further dehydrate the particles. The inner unit 606 may be configured commensurate with outer module 604. The inner unit heat vents 618 have a size of about 1 mm and are spread across the surface of the inner unit 606. The heat vents 618 do not get clogged because of constant, continuous flow of heated air pumped through the vents 618, which clears any clogged debris. As further illustrated, the chamber 602 further includes conduits 616 juxtaposed within a cavity 620 between the inner and outer units 604 and 606 aligned along a longitudinal axis of the third module 220 convey and inject heat from a heat pump 226 into the inner unit 606 via the heat vents 618 of the inner unit 606, with the heat pump 226 coupled with the third module 220 via heat pump line 622. The heat pump 226 is a conventional heat pump that operates at non-limiting 80,000 rpm. It should be noted that the illustrated conduits 616 juxtaposed within the cavity 620 in between the inner and outer units 604 and 606 are optional. That is, the heat pump 226 may simply directly pump hot air within the cavity 620 via the heat pump line 622, which will eventually enter the inner units via the heat vents 618.

As further illustrated in FIGS. 6A to 6E, the third module 220 further includes an eccentric, asymmetrical auger 630 accommodated within the third chamber 602, with the fourth motor M4 coupled to the third chamber 602 for rotating the auger 630. Further included is a scraper 632 coupled to a second end 634 of the auger 630 and a grill 636 coupled to the second end 614 of the third chamber 602 that pelletize the partially dehydrated smaller, compressed constituent parts into substantially dehydrated (about 60% dry) pellets 224.

The eccentric, asymmetrical auger 630 with flighting 638 is comprised of a cylindrical shaft 640 with helical screw blades 638 (i.e., flighting) with a first distal end 642 that couples with the fourth motor M4 and the second distal end 634 that is coupled with the scraper 632. The shaft sections 644 between the flightings 638 have progressively increasing diameter from the first end 640 to the second end 634. The first distal end 642 of the shaft 640 includes a first interlock section 646 that interlocks with the fourth motor M4, and proximal the first end 648 is a support bearing 650 that enables the shaft 640 to rotate. The second distal end 634 of the shaft 640 has a second interlock section 652 that accommodates the cleaner blade or scraper 632.

The helical screw blades 638 constituting the flighting include a progressively decreasing flighting thicknesses from the first to the second end of the shaft 240, with orientation of thicker sections "T" (T1, T2, T3, . . . , TN) of a flighting complementary to thinner portion "L" (L1, L2, L3, . . . , LN) of a juxtaposed, next, subsequent flighting 638. A progressively decreasing flight height due to progressively increasing shaft diameter "R" (R1, R2, R3, . . . , RN) of the shaft sections 644 between the flightings 638. The auger 630 further has a progressively decreasing distance "d" (d1, d2, d3, . . . , dN) between the flightings 638 from the first to the second end of the shaft 640, wherein volumes "V" (V1, V2, V3, . . . , VN) between flightings 638 of the auger 630 decreases from a first end to the second end of the shaft sections 644 between the flightings 638. The decreasing volume V enables finer granulation of the particles due to greater compression due to lesser space. The particles are further pushed and grinded, generating a further granulation of the particles. Therefore, the eccentric, asymmetrical auger 630 moves the particle from a first end 610 to the second 614 of the chamber 602 and simultaneously further grinds them. Accordingly, as the size of the particle is reduced, so does the volume V and hence, further grinding of the particles into smaller size.

Figure 6A:
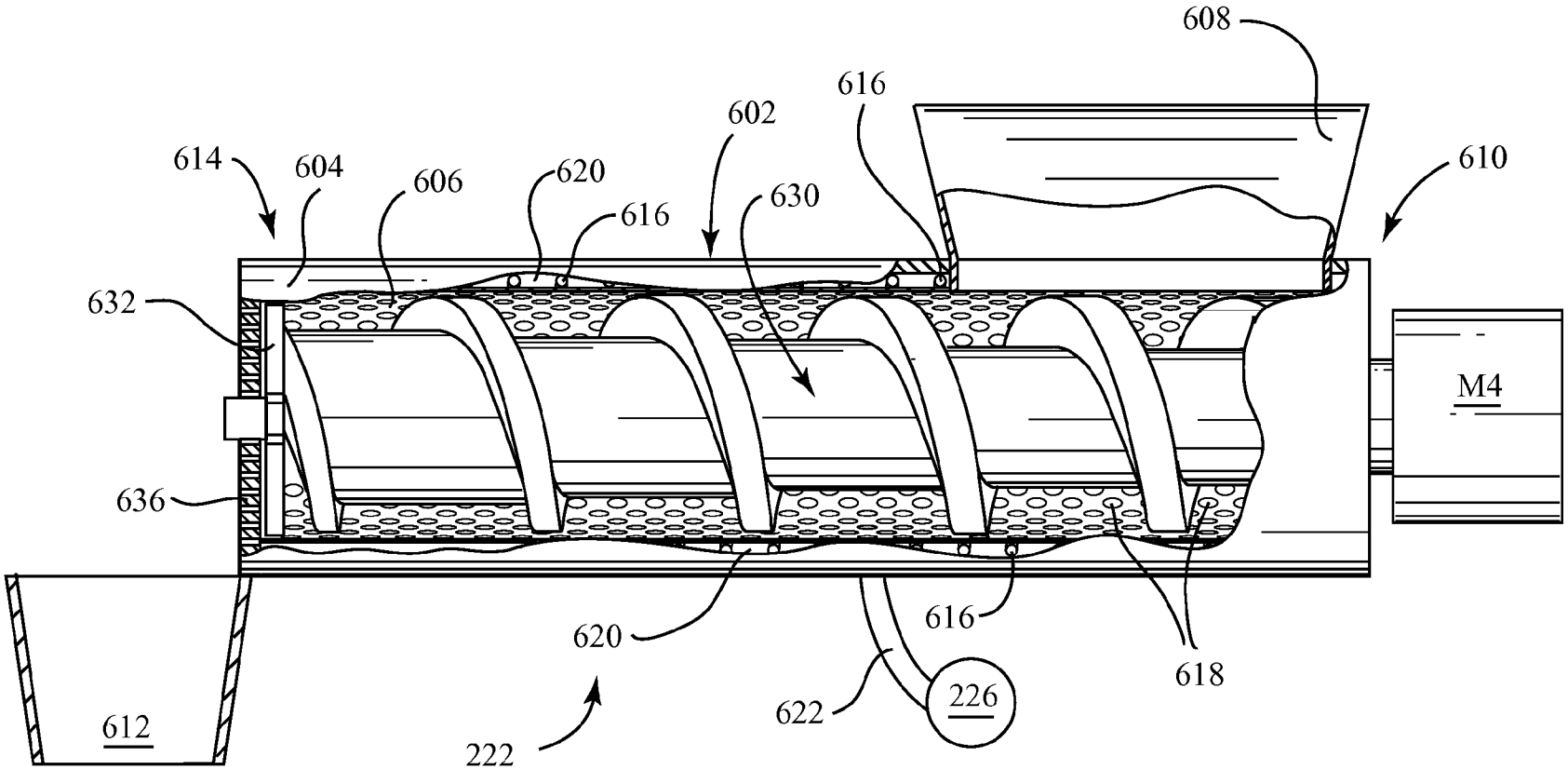
FIGS. 6A to 6E are non-limiting, exemplary illustrations of a third mechanism of a third module of a third stage of the device of FIGS. 1A to 5C in accordance with the present invention.
Figure 6B:
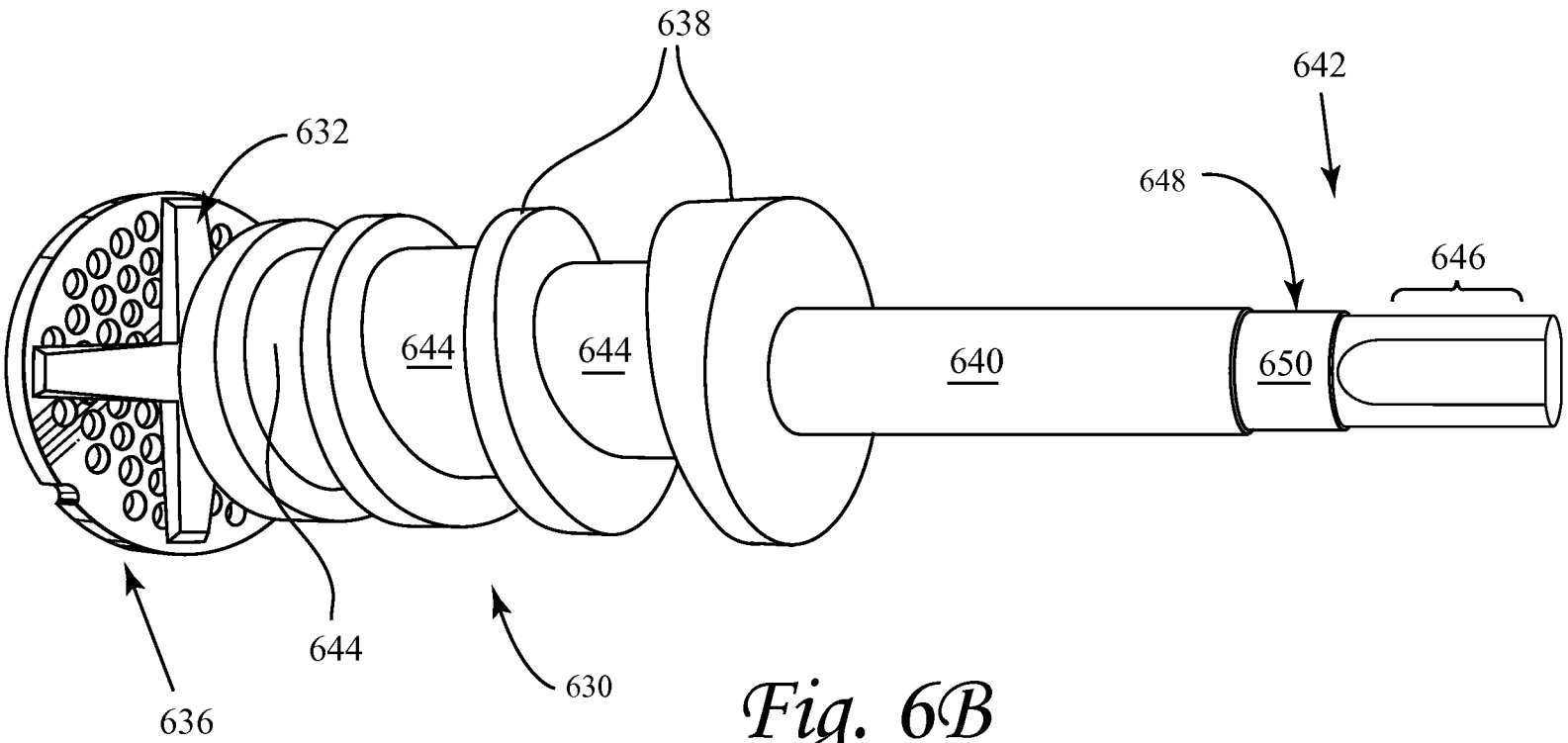
Figure 6C:
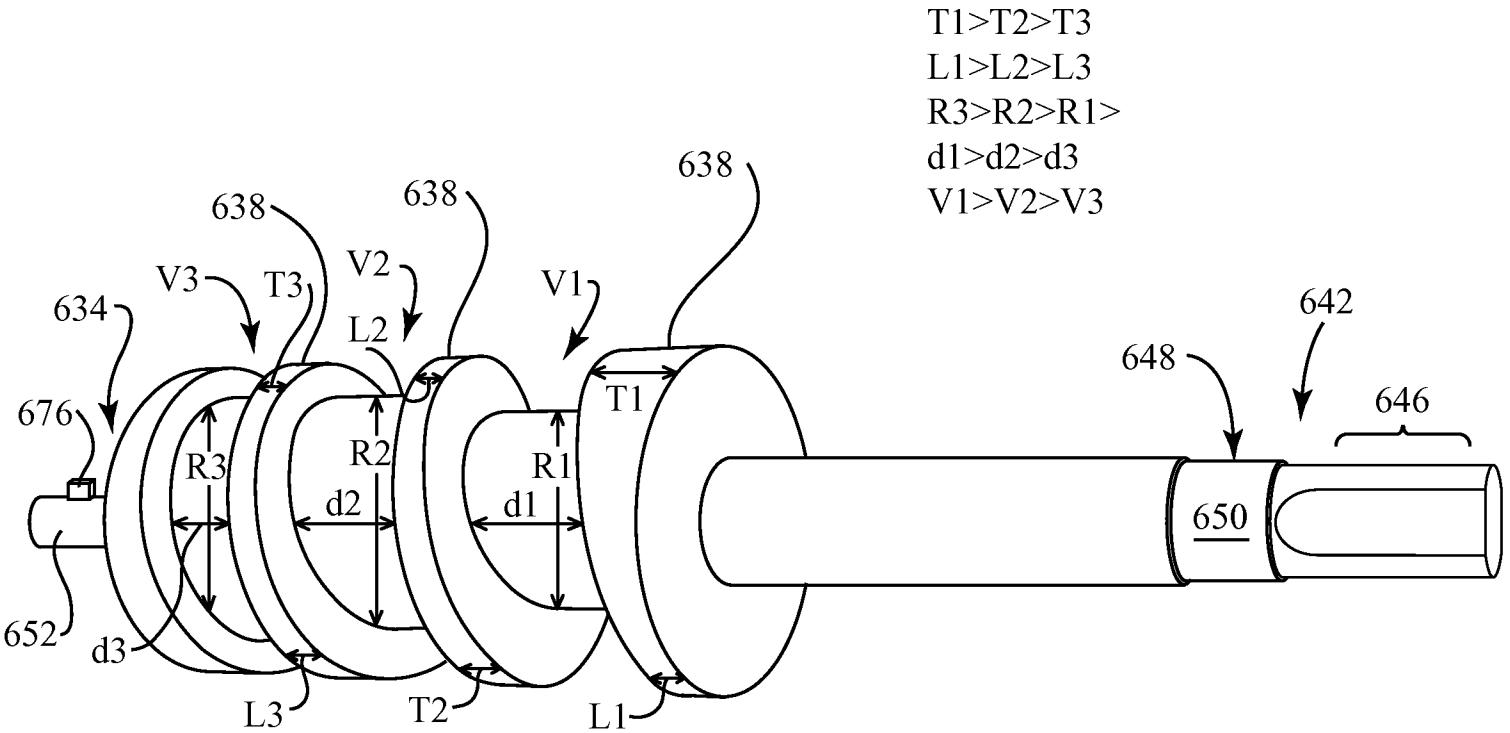
Figure 6D:
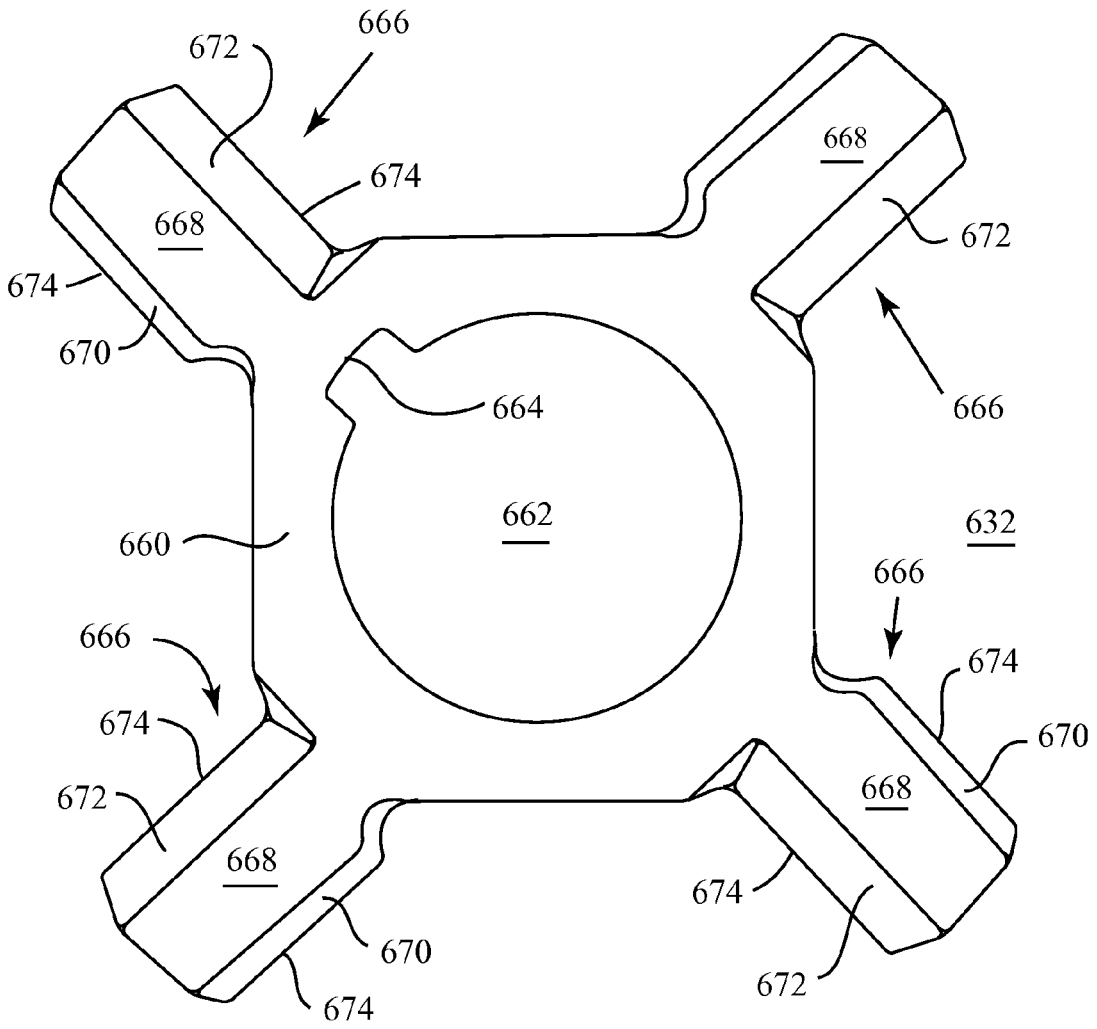
Figure 6E:
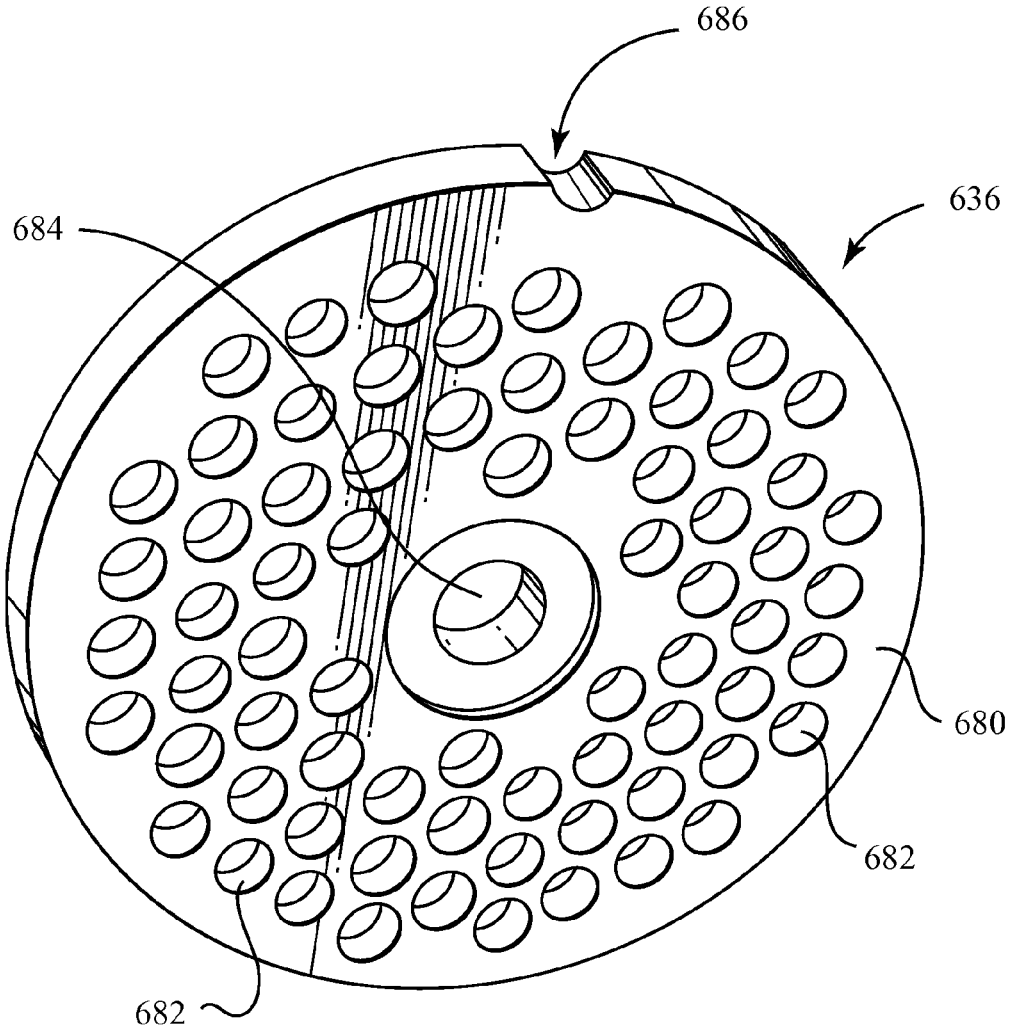

As best illustrated in FIGS. 6A, 6B, and 6D the scraper 632 is comprised of a body 660 and an cavity or hole 662 within the body 660 that receives the shaft 640 of the auger 630, with the hole 662 including a key-notch 664 that interlocks with a second end flange 634 of the shaft 640 (the second end flange 634 has complementary protrusion 676 that interlocks into the key-notch 664 to enable scraper 632 to interlock with and rotate with the shaft 640 rotation). The scraper 632 further includes a plurality of blades 666 that extend from the body 660 that have a top flat section 668 with beveled sides 670 and 672 that end at two lateral sharp edges 674 for severing and scraping particles, wherein the sharp edges 674 sever particles and the beveled sides 670 and 672 scrap up the remaining particle off of the grid 636. The grid 636 is comprised of a disc like structure 680 with a plurality of through-holes 682 for pelletizing the waste and a center hole 684 that receives the second end 634 of the auger shaft 640, including periphery notch 686 for interlocking with the second end 614 of the third chamber 602 to prevent the grid 636 from rotating. With respect to the third module, the grid and the scraper may be optionally removed so to generate simple non-pellet form fertilizer material.

Figure 7A:
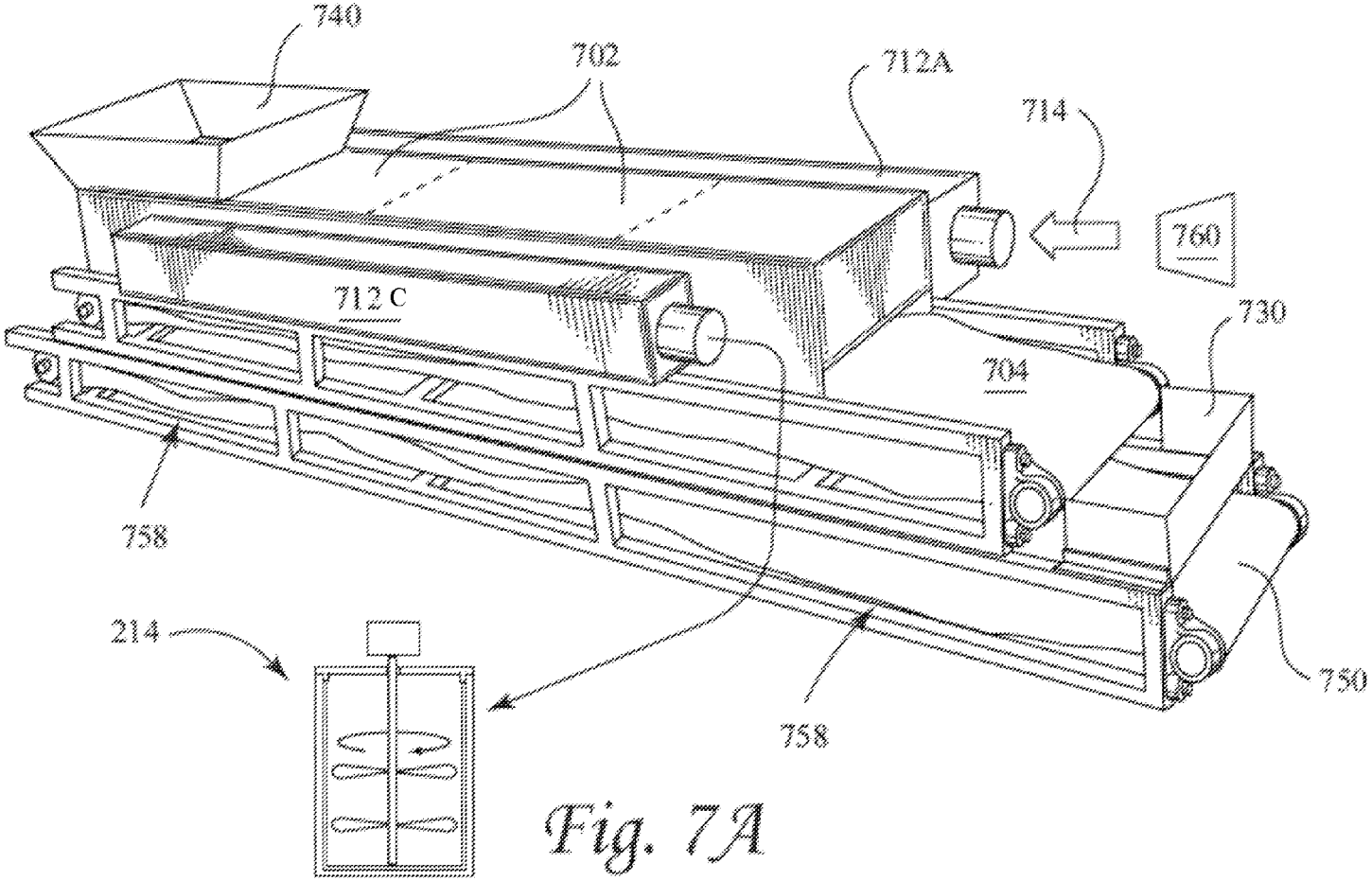
FIGS. 7A to 7D are non-limiting, exemplary illustrations of a fourth and fifth mechanisms of a fourth and fifth modules of fourth and fifth stages of the device of FIGS. 1A to 6E in accordance with the present invention.
Figure 7B:
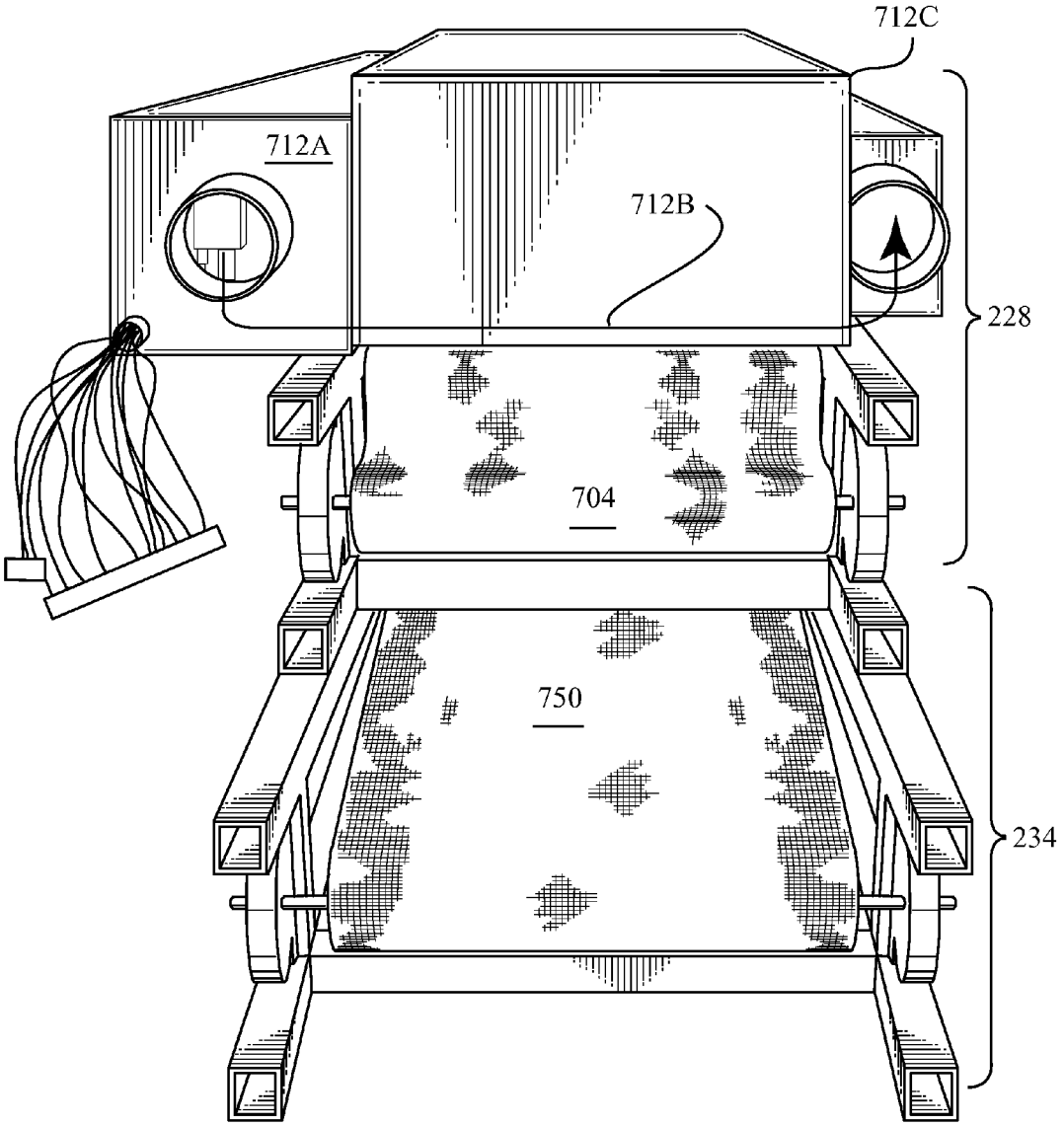
Figure 7C:
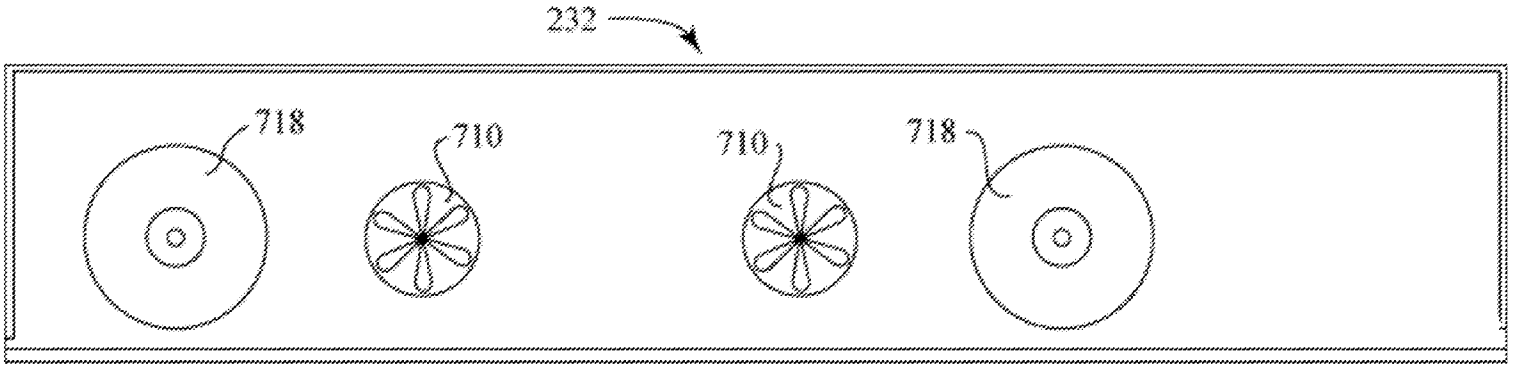
Figure 7D:
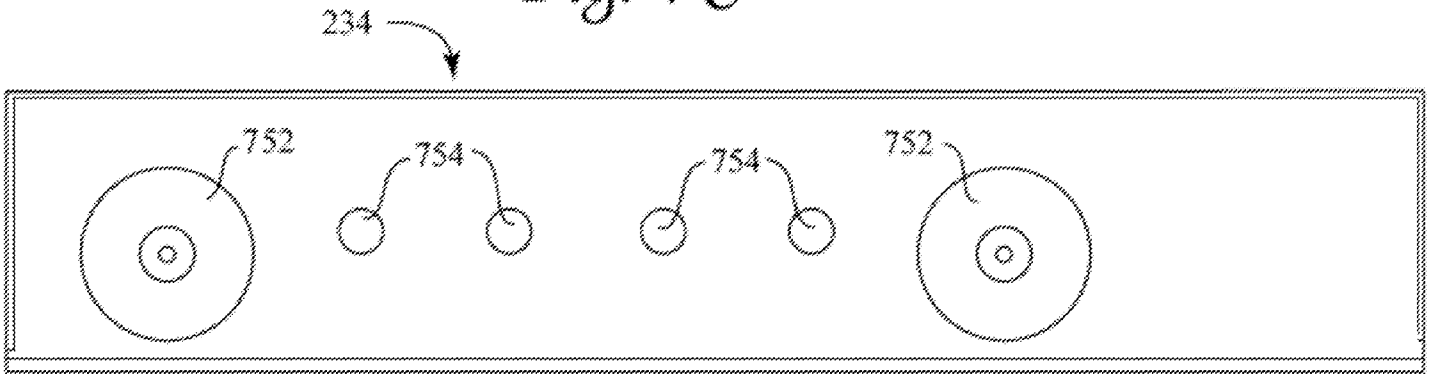

FIGS. 7A to 7D are non-limiting, exemplary illustrations of a fourth and fifth mechanisms of a fourth and fifth modules of fourth and fifth stages of the device of FIGS. 1A to 6E in accordance with the present invention. As illustrated in FIGS. 7A to 7D, the device 100 also includes the fourth stage 228 that receives the highly dense substantially dehydrated pellets 224 via the hopper 740, and includes a fourth mechanism 232 that further dry the pellets 224. The fourth module 230 is comprised of one or more closed chambers 702 and a conveyer mechanism 704 with one or more conveyer motors 718 (FIG. 7C) that moves the highly dense substantially dehydrated pellets 224 through the one or more closed chambers 702 that include dryer elements 710 associated with each chamber 702 to further dry the pellets 224. The detachable blocking element 730 prevent the pellets 224 existing the fourth stage 228 that fall off the conveyer 704 and into the next stage from falling out of the device 100. Non-limiting examples of dyer elements 710 may comprise of any one or more of microwave dryers, heating elements, etc., or any combinations thereof. The fourth stage 228 further includes an exhaust channel 712 (i.e., 712A, 712B, and 712C) along the sides of the fourth mechanism 232 wherein forced air 714 is pushed by an air pump 760 into the channel 712A to exhaust accumulated heat from the one or more chambers 702, passing through the channel 712B (FIG. 7B) and directed into channel 712C where the air exists out and is directed and recycled into the storage module 214. The recycled heated air from the fourth module 230 and into the storage module 214 enables a more efficient use and operation of the heat element 244 of the storage module. FIG. 7B further discloses exposed wiring that provide power to dryer elements 710. As indicated above, the dryer elements 710 may comprise of microwaves and resistive heating elements that further dry the pellets 224 and substantially destroy most bacteria.

As further illustrated in FIGS. 7A to 7D, the device 100 further includes a fifth stage 234 that includes a fifth module 236 that receives the substantially dried, heated pellets 224 from the preceding forth stage 228, and includes a fifth mechanism 238 for cooling the heated pellets 224, which increase the pellet density. The fifth stage module 236 include a conveyer mechanism 750 with one or more conveyer motors 752 that moves the dehydrated, heated pellets 224 across the fifth mechanism comprised of cooling fans 754 that deliver cool air into a continuous fifth chamber to cool the pellets 224. It should be noted that the fifth stage 234 is closed along the sides 758 (FIG. 7A), forming the fifth chamber, but left open in the illustration for clarity.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. For example, the dimensions of the various elements, amounts of pressure and heat applied, speed of processing and so on may be varied depending on the type of waste and mixtures thereof being processed. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A method for conversion of waste to sources of energy, comprising:

receiving waste;

reducing a size of the received waste into smaller constituent parts;

compressing and extracting liquid from smaller constituent parts, and generating partially dehydrated smaller constituent parts;

drawing out the liquid;

filtering solids of the liquid, and storing the liquid as a first source of energy;

receiving the partially dehydrated smaller constituent parts;

compressing, grinding, and applying of heat to the partially dehydrated smaller constituent parts;

applying further heat to the compressed, grinded, and heated partially dehydrated smaller constituent parts for further dehydration thereof;

cooling the further dehydrated smaller constituent parts to form dense dry pellets as a second source of energy.

2. A device for conversion of waste to sources of energy, comprising:

a first stage that reduces a size of received waste into smaller constituent parts;

a second stage that applies compressive force to compress and further extract liquid from smaller constituent parts, generating partially dehydrated smaller constituent parts, with the liquid stored as a first source of energy;

a third stage that receives the partially dehydrated, compressed smaller constituent parts, and further compresses, grinds, and applies heat to pulverize the constituent parts into dense substantially dehydrated material;

a fourth stage that further dries the material;

a fifth stage that receives the further dried material, and cools the further dried material, which increase the material density; and a controller for controlling each operational stage.

3. The device for conversion of waste to sources of energy, as set forth in claim 2, wherein:

the material is one of fertilizer and pellets.

4. A device for conversion of waste to sources of energy, comprising:

a receiving member to receive waste;

a first stage that includes a first module to reduce a size of the received waste into smaller constituent parts;

a second stage that includes a second module that comprises a second mechanism to apply a compressive force to compress the smaller constituent parts and extract liquid from the smaller constituent parts, generating partially dehydrated and compressed smaller constituent parts, with the extracted liquid drawn out via a vacuum pump, filtered to remove solids, and stored as a first source of energy within a storage module;

a third stage that includes a third module that receives the partially dehydrated, compressed smaller constituent parts, and includes a third mechanism to further compress, grind, and apply heat to pulverize the partially dehydrated, compressed smaller constituent parts into dense substantially dehydrated pellets;

a fourth stage that includes a fourth module that receives the dense substantially dehydrated pellets, and includes a fourth mechanism that further dries the dense substantially dehydrated pellets to form substantially dried, heated pellets;

a fifth stage that includes a fifth module that receives the substantially dried, heated pellets, and includes a fifth mechanism to cool the substantially dried, heated pellets, which increase a density of the substantially dried, heated pellets; and a controller for controlling each operational stage.

5. The device for conversion of waste to sources of energy as set forth in claim 4, wherein:

the storage module includes:

a container within which is included a heating element to substantially eliminate odor and bacteria, and an agitator that continuously mixes the liquid for even distribution of heat.

6. The device for conversion of waste to sources of energy as set forth in claim 5, wherein:

the agitator is comprised of:

a motor;

a shaft coupled with a motor; and a set of rotator blades coupled with the shaft that rotate to mix the stored liquid.

7. The device for conversion of waste to sources of energy as set forth in claim 4, wherein:

the device is compact in size and placed onto a mobile platform.

8. The device for conversion of waste to sources of energy as set forth in claim 4, wherein:

the receiving member is a feed mechanism in the form of a hopper.

9. The device for conversion of waste to sources of energy as set forth in claim 8, wherein:

the hopper has an ingress cross-sectional opening for receiving the waste, and an egress cross-sectional opening that enables a part of the first mechanism of the first stage to extend out from the egress cross-sectional opening.

10. The device for conversion of waste to sources of energy as set forth in claim 9, wherein:

the ingress cross-sectional opening of the hopper is wider than the egress cross-sectional opening thereof.

11. The device for conversion of waste to sources of energy as set forth in claim 4, wherein:

the first module of the first stage includes a shredder mechanism that masticates, chops, shreds, and grinds waste into smaller constituent parts.

12. The device for conversion of waste to sources of energy as set forth in claim 11, wherein:

the shredder is comprised of a shredder assembly, a first motor, and a drain for removal of liquid from the shredder assembly, with the drain coupled to a first vacuum line.

13. The device for conversion of waste to sources of energy as set forth in claim 12, wherein:

the shredder assembly includes:

a shredder housing that accommodates a dual shaft shredder with a dual shaft transmission system;

the dual shaft shredder is comprised of a first and second shredder shaft assemblies that are associated with the shredder housing.

14. The device for conversion of waste to sources of energy as set forth in claim 13, wherein:

the first shredder shaft assembly includes:

a first shredder shaft that has a first polygonal cross-section with a first axial length that further includes a first drive-shaft end and a first bearing-shaft end;

a first set of shredder plates that are substantially equally spaced, juxtaposed adjacent one another, mounted onto, and aligned along the first axial length of the first shredder shaft;

the first drive-shaft end includes a first gear assembly coupled with a second gear assembly with one of the first or second gear assemblies coupled with a drive shaft of the first motor;

wherein when the drive shaft of the motor rotates a gear assembly coupled therewith, both the first and second shredder shaft assemblies rotate;

wherein the first gear assembly rotates clockwise and the second gear assembly rotates counterclockwise so that an upper section of rotation of both the first and second gear assemble are towards one another.

15. The device for conversion of waste to sources of energy as set forth in claim 14, wherein:

the second shredder shaft assembly includes:

a second shredder shaft that has a second polygonal cross-section with a second axial length that further includes a second drive-shaft end and a second bearing-shaft end;

a second set of shredder plates that are substantially equally spaced, juxtaposed adjacent one another, mounted onto and aligned along the second axial length of the second shredder shaft;

the second drive-shaft end includes the second gear assembly coupled with the first gear assembly, with one of the first or second gear assemblies coupled with a drive shaft motor.

16. The device for conversion of waste to sources of energy as set forth in claim 15, wherein:

the first and second shredder shafts are positioned within the shredder housing and juxtaposed adjacent one another longitudinally along their respective first and second axial lengths with the first and second drive-shaft end of the first and second shredder shafts associated with a first wall of the shredder housing, and the first and second bearing-shaft end of the first and second shredder shaft associated with a second wall of the shredder housing, with the first and second walls of the shredder housing oriented transverse a longitudinal axis of the first and second shredder shafts.

17. The device for conversion of waste to sources of energy as set forth in claim 16, wherein:

the first set of shredder plates encroach a second set of void spaces of the second shredder shaft assembly, and the second set of shredder plates encroach a first set of void spaces of the first shredder shaft assembly.

18. The device for conversion of waste to sources of energy as set forth in claim 17, wherein:

the shredder plates have a pivot axis that is normal to a radial plane of the shredder plates;

the shredder plates have a substantially disc structure with a thickness along the pivot axis, a diameter that defines a span of the lateral face, which is the radial plane of the shredder plates, a circumference that defines the radial outer periphery, and a radial center;

severing members that protrude from a radial outer periphery of the shredder plates;

a mounting through-hole oriented transverse the radial plane for insertion of a shredder shaft and mounting of the shredder plate thereon, with the mounting through-hole having a perimeter and a cross-sectional span that is configured commensurate with the cross-section of the shredder shaft.

19. The device for conversion of waste to sources of energy as set forth in claim 18, wherein:

the mounting through-hole is at the radial center of the shredder plates.

20. The device for conversion of waste to sources of energy as set forth in claim 19, wherein:

the severing members protrude from the radial outer periphery of a shredder plate at a progressively smooth increasing angle, forming a radial outward projecting shoulder that ends at a tip, forming a radial recessed inner portion, with the radial outward projecting shoulder and the radial recessed inner portion constituting a cutting-wing of the severing member; and the shredder plates further include indentations along the radial outer periphery;

indentations are positioned between the tips, and define a start position from which the severing members commence protruding, and an end position at which the radial outer periphery from an end of the radial recessed inner portion ends;

wherein the indentations are used to further agitate, mix and facilitate a grip of the waste products by the severing members.

21. The device for conversion of waste to sources of energy as set forth in claim 20, wherein:

the tip of the severing members facilitates mounting and installation of blades by a set of fasteners, with the blades covering the tip along the thickness of the shredder plate and is comprised of carbide and alloys thereof.

22. The device for conversion of waste to sources of energy as set forth in claim 20, wherein:

the tip of the cutting-wing of a shredder plate on a shredder shaft is oriented in the same direction of the orientation of the tip of the cutting-wing of a next adjacent shredder plate on the same shredder shaft.

23. The device for conversion of waste to sources of energy as set forth in claim 4, wherein:

the second module includes:

a second chamber, which includes:

a second motor at a first end of the second chamber and a third motor at a second end of the second chamber;

the second motor is coupled with a piston shaft of a piston to move the piston along a longitudinal axis of the second chamber to compress the smaller constituent parts into a substantially dehydrated smaller constituent parts; and the third motor is a bidirectional rotating motor that is coupled with a plate shaft of a plate for bidirectional rotation of the plate along a bidirectional reciprocating rotational path;

with the second motor pushing the smaller constituent parts from the first end to the second end of the second chamber, towards the pivoting plate, while the pivoting plate rotates back-and-forth to further compress and squeeze out and extract further liquid from the smaller constituent parts;

a second vacuum line positioned near the first end of the second chamber and a third vacuum line positioned near the second end of the second chamber remove the extracted liquid.

24. The device for conversion of waste to sources of energy as set forth in claim 23, wherein:

the second chamber is a compression chamber that includes an outer module and an inner module;

the outer module includes an ingress hopper connected near the first end and an egress hopper connected opposite the ingress hopper near the second end, and further includes coupling mechanisms for the second and third motors and the vacuum lines;

the inner module is comprised of drainage apertures that enable accumulated liquid within the inner module to drain out into the outer module and be removed by the vacuum lines.

25. The device for conversion of waste to sources of energy as set forth in claim 24, wherein:

the piston is a compression piston.

26. The device for conversion of waste to sources of energy as set forth in claim 25, wherein:

the compression chamber is a hydraulic compression chamber and the second motor is a hydraulic motor.

27. The device for conversion of waste to sources of energy as set forth in claim 26, wherein:

a compression piston and the plate are comprised of:

a disc with a first and second sides;

the first side faces and contacts the smaller constituent parts, and includes a surface with protrusions and indentations to grip and squeeze particles;

the second side is substantially flat and faces connection points of the piston shaft and the third motor shaft.

28. The device for conversion of waste to sources of energy as set forth in claim 4, wherein:

the third module includes a third chamber, having:

an outer unit and an inner unit;

the outer unit includes an ingress hopper connected near a first end and an egress hopper connected opposite the ingress hopper at a second end, and further includes coupling mechanisms for a fourth motor and heat pump lines;

the inner unit is comprised of heat vents that enable heat to be pumped within the inner unit (and confined within the outer unit) to further dehydrate the particles.

29. The device for conversion of waste to sources of energy as set forth in claim 28, wherein:

conduits juxtaposed within a cavity between the inner and outer units aligned along a longitudinal axis of the third module convey and inject heat from a heat pump into the inner unit via the heat vents of the inner unit, with the heat pump coupled with the third module.

30. The device for conversion of waste to sources of energy as set forth in claim 29, wherein:

the third module further includes:

an eccentric, asymmetrical auger accommodated within the third chamber;

a fourth motor coupled to the third chamber that rotates the auger;

a scraper coupled to a second end of the auger and a grill coupled to the second end of the third chamber that pelletize the partially dehydrated smaller, compressed constituent parts into substantially dehydrated pellets.

31. The device for conversion of waste to sources of energy as set forth in claim 30, wherein:

the eccentric, asymmetrical auger with flighting is comprised of:

a cylindrical shaft with helical screw blades with a first distal end that is coupled with the fourth motor and a second distal end that coupled with the scraper;

shaft sections between the flightings have progressively increasing diameter from the first distal end to the second distal end;

the first distal end of the shaft includes a first interlock section that interlocks with the fourth motor, and proximal the first end is a support bearing that enables the shaft to rotate;

the second distal end of the shaft has a second interlock section that accommodates the cleaner blade;

the helical screw blades constituting the flighting include:

a progressively decreasing flighting thicknesses from the first to the second distal end of the shaft, with orientation of a thicker section of a flighting complementary to thinner portion of a juxtaposed, next, subsequent flighting;

a progressively decreasing flight height due to a progressively increasing shaft diameter of the shaft sections between the flightings;

a progressively decreasing distance between the flightings from the first to the second distal end of the shaft;

wherein volume between flightings of the auger decreases from a first distal end to the second distal end of the shaft sections between the flightings.

32. The device for conversion of waste to sources of energy as set forth in claim 31, wherein:

the scraper is comprised of:

a body;

an aperture within the body that receives the shaft of the auger, with the aperture including a key-notch that interlocks with a second end flange of the shaft; and a plurality of blades that extend from the body:

a top, flat section with beveled sides that end at two lateral edges for severing and scraping the smaller constituent parts;

wherein the sharp edges sever particles and the beveled sides scrape up the remaining smaller constituent parts off of a grid.

33. The device for conversion of waste to sources of energy as set forth in claim 4, wherein:

a fourth stage includes a fourth module that receives the dense substantially dehydrated pellets, and includes a fourth mechanism that further dry the pellets;

the fourth module is comprised of:

one or more chambers;

a conveyer mechanism that moves the dense substantially dehydrated pellets through the one or more chambers that include the fourth mechanism comprised of dryer elements associated with each chamber to further dry the pellets;

an exhaust channel along both longitudinal sides of the fourth module wherein forced air pushes accumulated heat from the one or more chambers and exits and is directed to the storage module; and wiring that provide power to dryer elements.

34. The device for conversion of waste to sources of energy as set forth in claim 33, wherein:

dryer elements are microwaves and resistive heating elements that further dry the pellets and substantially destroy most bacteria.

35. The device for conversion of waste to sources of energy as set forth in claim 4, wherein:

a fifth stage includes a fifth module that receives the substantially dried, heated pellets, and includes a fifth mechanism for cooling the heated pellets, which increase the pellet density;

the fifth module includes:

a conveyer mechanism that moves the dehydrated, heated pellets across the fourth mechanism comprised of cooling fans that deliver cool air into a continuous fifth chamber to cool the pellets.

* * * * *